US009080412B2

(12) United States Patent
Wetzel et al.

(10) Patent No.: US 9,080,412 B2
(45) Date of Patent: Jul. 14, 2015

(54) GRADATIONAL INSERTION OF AN ARTIFICIAL LIFT SYSTEM INTO A LIVE WELLBORE

(71) Applicant: Zeitecs B.V., Rijswijk (NL)

(72) Inventors: James Rudolph Wetzel, Houston, TX (US); Evan Sheline, Houston, TX (US); Neil Griffiths, Houston, TX (US)

(73) Assignee: Zeitecs B.V., Rijswijk (NL)

( * ) Notice: Subject to any disclaimer, the term of this patent is extended or adjusted under 35 U.S.C. 154(b) by 309 days.

(21) Appl. No.: 13/652,274

(22) Filed: Oct. 15, 2012

(65) Prior Publication Data

US 2013/0098632 A1 Apr. 25, 2013

Related U.S. Application Data

(60) Provisional application No. 61/550,537, filed on Oct. 24, 2011.

(51) Int. Cl.

| | |
|---|---|
| ***E21B 19/16*** | (2006.01) |
| ***E21B 33/072*** | (2006.01) |
| ***E21B 43/12*** | (2006.01) |

(52) U.S. Cl.

CPC ..... *E21B 33/072* (2013.01); *E21B 19/16* (2013.01); *E21B 19/161* (2013.01); *E21B 43/128* (2013.01)

(58) Field of Classification Search

CPC ..... E21B 19/00; E21B 19/16; E21B 19/161
USPC ..... 166/379, 75.51, 85.1
See application file for complete search history.

(56) References Cited

U.S. PATENT DOCUMENTS

| | | | | |
|---|---|---|---|---|
| 4,825,953 | A | 5/1989 | Wong et al. | |
| 4,967,472 | A | 11/1990 | Ebihara et al. | |
| 6,018,136 | A | 1/2000 | Ohmi et al. | |
| 6,315,051 | B1 | 11/2001 | Ayling | |
| 6,811,382 | B2 | 11/2004 | Buchanan et al. | |
| 6,913,084 | B2 | 7/2005 | Boyd | |
| 7,107,875 | B2 | 9/2006 | Haugen et al. | |
| 7,584,798 | B2 | 9/2009 | Dallas | |
| 7,845,412 | B2 | 12/2010 | Sbordone et al. | |
| 8,047,295 | B2 | 11/2011 | Skeels et al. | |
| 2008/0173441 | A1 * | 7/2008 | Bowles et al. | 166/70 |

OTHER PUBLICATIONS

PCT International Search Report and Written Opinion dated Nov. 7, 2013, in International Application No. PCT/US2012/059811.

* cited by examiner

*Primary Examiner* — Brad Harcourt
(74) *Attorney, Agent, or Firm* — Patterson & Sheridan, L.L.P.

(57) ABSTRACT

A method of inserting a downhole assembly into a live wellbore, includes: assembling a pressure control assembly (PCA) onto a production tree of the live wellbore; inserting a first deployment section of the downhole assembly into a lubricator; landing the lubricator onto the PCA; connecting the lubricator to the PCA; lowering the first deployment section into the PCA; engaging a clamp of the PCA with the first deployment section; after engaging the clamp, isolating an upper portion of the PCA from a lower portion of the PCA; and after isolating the PCA, removing the lubricator from the PCA.

10 Claims, 15 Drawing Sheets

GRADATIONAL INSERTION OF AN ARTIFICIAL LIFT SYSTEM INTO A LIVE WELLBORE

BACKGROUND OF THE INVENTION

1. Field of the Invention

Embodiments of the present invention generally relate to gradational insertion of an artificial lift system into a live wellbore.

2. Description of the Related Art

The oil industry has utilized electric submersible pumps (ESPs) to produce high flow-rate wells for decades, the materials and design of these pumps has increased the ability of the system to survive for longer periods of time without intervention. These systems are typically deployed on the tubing string with the power cable fastened to the tubing by mechanical devices such as metal bands or metal cable protectors. Well intervention to replace the equipment requires the operator to pull the tubing string and power cable requiring a well servicing rig and special spooler to spool the cable safely. The industry has tried to find viable alternatives to this deployment method especially in offshore and remote locations where the cost increases significantly. There has been limited deployment of cable inserted in coil tubing where the coiled tubing is utilized to support the weight of the equipment and cable. Although this system is seen as an improvement over jointed tubing, the cost, reliability and availability of coiled tubing units have prohibited use on a broader basis. Current intervention methods of deployment and retrieval of submersible pumps require well control by injecting heavy weight (a.k.a. kill) fluid in the wellbore to neutralize the flowing pressure thus reducing the chance of loss of well control.

SUMMARY OF THE INVENTION

Embodiments of the present invention generally relate to gradational insertion of an electric submersible pump (ESP) into a live wellbore. In one embodiment, a method of inserting a downhole assembly into a live wellbore, includes: assembling a pressure control assembly (PCA) onto a production tree of the live wellbore; inserting a first deployment section of the downhole assembly into a lubricator; landing the lubricator onto the PCA; connecting the lubricator to the PCA; lowering the first deployment section into the PCA; engaging a clamp of the PCA with the first deployment section; after engaging the clamp, isolating an upper portion of the PCA from a lower portion of the PCA; and after isolating the PCA, removing the lubricator from the PCA.

In another embodiment, a pressure control assembly for inserting a downhole assembly into a live wellbore, includes: a first clamp comprising a housing having a bore therethrough and bands or slips, each band or slip radially movable relative to the first clamp housing into and from the first clamp bore; a second clamp comprising a housing having a bore therethrough and bands or slips, each second band or slip radially movable relative to the second clamp housing into and from the second clamp bore; a preventer or packer comprising a housing having a bore therethrough, a seal, and an actuator operable to extend and retract the seal into and from the preventer or packer housing bore; an isolation valve comprising a housing having a bore therethrough and a valve member operable to open and close the valve bore; and a driver comprising a housing having a bore therethrough and a wrench radially movable relative to the housing into and from the driver bore, the wrench comprising a motor and a socket, the socket operable to engage a threaded fastener and the motor operable to rotate the socket, wherein the clamp housings, the preventer or packer housing, the valve housing, and the driver housing are connected to form a continuous bore through the assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 7A-14C illustrate insertion of the ESP into a wellbore using the LARS.

DETAILED DESCRIPTION

Figure 1:
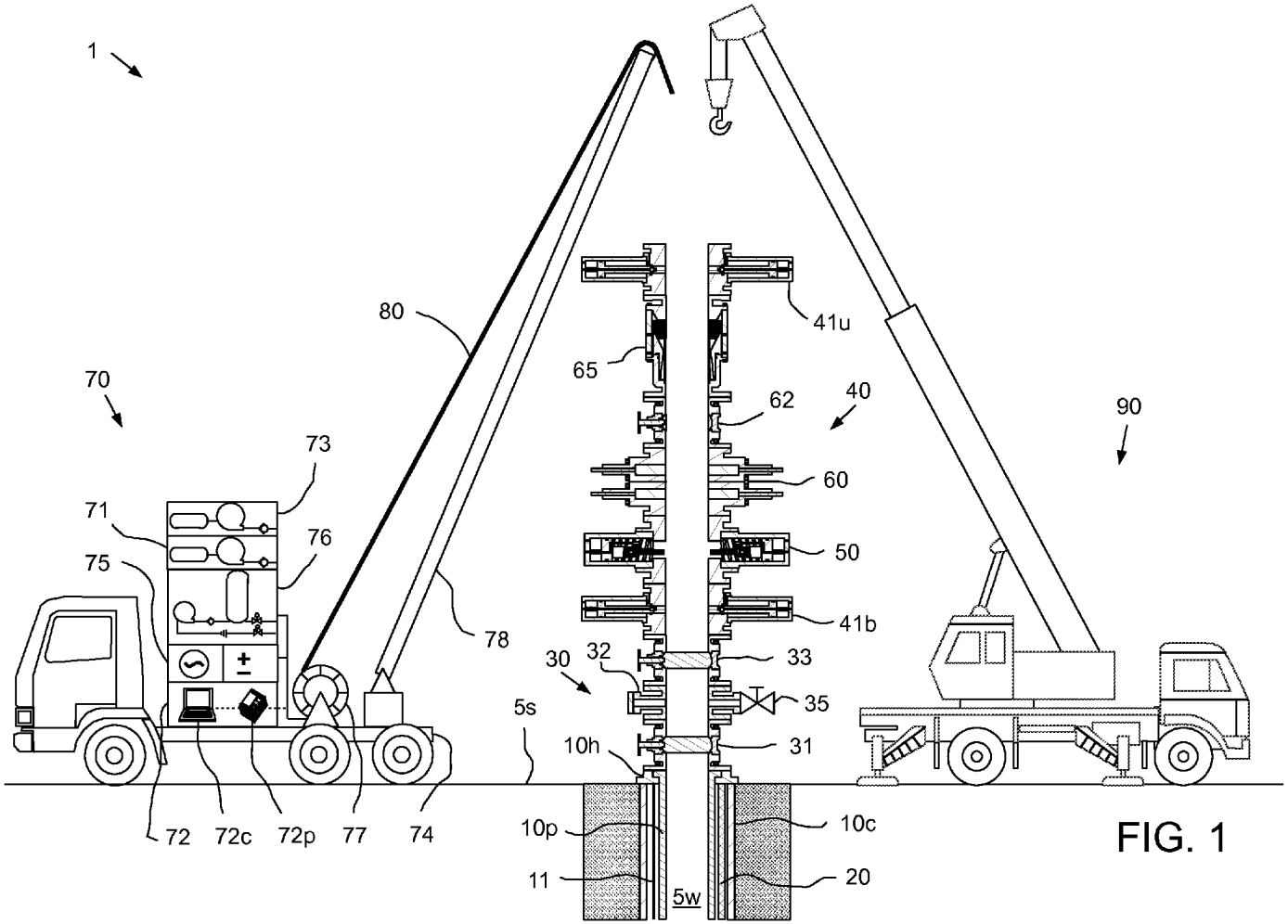
FIG. 1 illustrates deployment of a launch and recovery system (LARS) to a wellsite, according to one embodiment of the present invention.

FIG. 1 illustrates deployment of a launch and recovery system (LARS) 1 to a wellsite, according to one embodiment of the present invention. The LARS 1 may include a pressure control assembly 40, a wireline truck 70, a crane 90, a lubricator 200 (FIG. 6A), and one or more running tools 250*a,b* (FIGS. 6B and 7A).

Figure 14A:
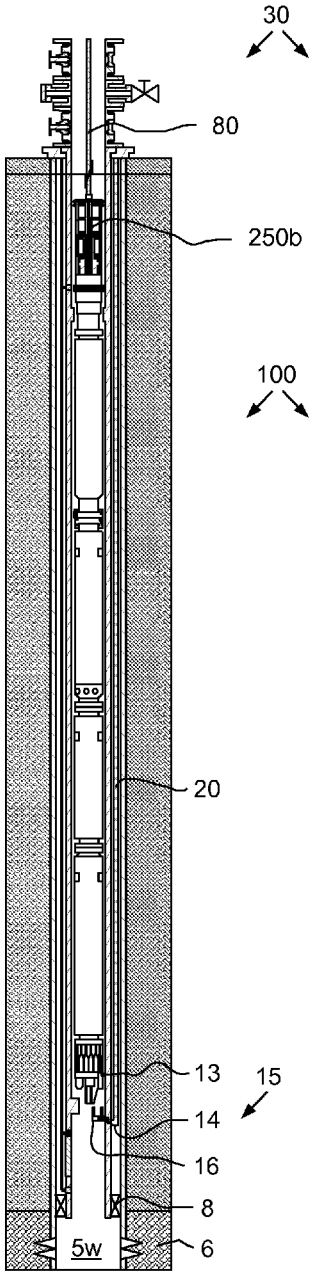

A wellbore 5*w* has been drilled from a surface 5*s* of the earth into a hydrocarbon-bearing (i.e., crude oil and/or natural gas) reservoir 6 (FIG. 14A). A string of casing 10*c* has been run into the wellbore 5*w* and set therein with cement (not shown). The casing 10*c* has been perforated 9 (FIG. 14B) to provide to provide fluid communication between the reservoir 6 and a bore of the casing 10*c*. A wellhead 10*h* has been mounted on an end of the casing string 10*c*. A string of production tubing 10*p* extends from the wellhead 10*h* to the reservoir 6 to transport production fluid 7 (FIG. 14C) from the reservoir 6 to the surface 5*s*. A packing 8 (FIG. 14A) has been set between the production tubing 10*p* and the casing 10*c* to isolate an annulus 10*a* (FIG. 14B) formed between the production tubing and the casing from production fluid 7.

A production (aka Christmas) tree 30 has been installed on the wellhead 10*h*. The production tree 30 may include a master valve 31, tee 32, a swab valve 33, a cap 34 (FIG. 14C), and a production choke 35. Production fluid 7 from the reservoir 6 may enter a bore of the production tubing 10*p*, travel through the tubing bore to the surface 5*s*. The production fluid 7 may continue through the master valve 31, the tee 32, and through the choke 35 to a flow line (not shown). The production fluid 7 may continue through the flow line to a separation, treatment, and storage facility (not shown). The reservoir 6 may initially be naturally producing and may deplete over time to require an artificial lift system (ALS) to maintain production. The ALS may include a control unit 39 (FIG. 14C) located at the surface 5*s*, a power cable 20, and a downhole assembly, such as an electrical submersible pump (ESP) 100 (FIGS. 3A-3D). Alternatively, the downhole assembly may include an electrical submersible compressor. In anticipation of depletion, the production tubing string 10*p* may have been installed with a dock 15 (FIG. 14A) assembled as a part thereof and the power cable 20 secured therealong.

The dock 15 may receive a lander 105 of the ESP 100 and include a subsurface safety valve (SSV) 3, one or more sensors 4*u,b*, a part, such as one or more followers 13, of an auto-orienter, a penetrator 14, a part, such as one or more boxes 16, of a wet matable connector, a polished bore receptacle (PBR) 17, and a torque profile. The SSV 3 may include a housing, a valve member, a biasing member, and an actuator. The valve member may be a flapper operable between an open position and a closed position. The flapper may allow flow through the housing/production tubing bore in the open position and seal the housing/production tubing bore in the closed position. The flapper may operate as a check valve in the closed position i.e., preventing flow from the reservoir 6 to the wellhead 10*h* but allowing flow from the wellhead to the reservoir. Alternatively, the SSV 3 may be bidirectional. The actuator may be hydraulic and include a flow tube for engaging the flapper and forcing the flapper to the open position. The flow tube may also be a piston in communication with a hydraulic conduit of a control line 11 extending along an outer surface of the production tubing 10*p* to the wellhead 10*h*. Injection of hydraulic fluid into the conduit may move the flow tube against the biasing member (i.e., spring), thereby opening the flapper. The SSV 3 may also include a spring biasing the flapper toward the closed position. Relief of hydraulic pressure from the conduit may allow the springs to close the flapper.

Figures 5A, 5B, 5C, 5D:
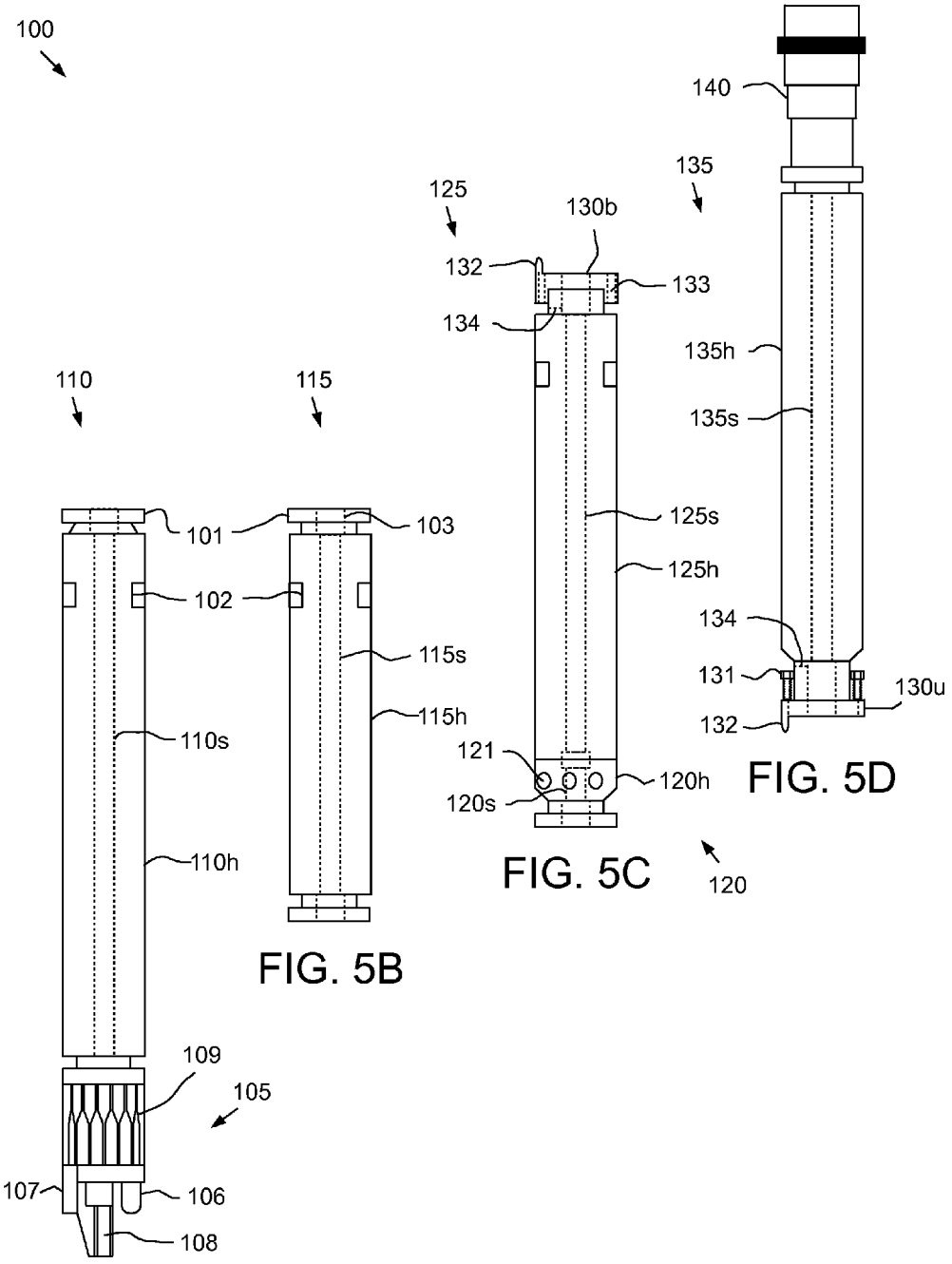
FIGS. 5A-5D illustrate an electric submersible pump (ESP) of the ALS.

Each sensor 4*u,b* may be a pressure or pressure and temperature (PT) sensor. The sensors 4*u,b* may be located along the production tubing 10*p* so that the upper sensor 4*u* is in fluid communication with an outlet of the ESP 100 and a lower sensor 4*b* is in fluid communication with an inlet 120 (FIG. 5C) of the ESP 100. The sensors 4*u,b* may be in data communication with a motor controller (not shown) of the control unit 39 via a data conduit of the control line 11, such as an electrical or optical cable. The data conduit may also provide power for the sensors 4*u,b*.

The penetrator 14 may receive an end of the cable 20. The cable 20 may be fastened along an outer surface of the production tubing 10*p* at regular intervals, such as by clamps or bands (not shown). The wet matable connector 16, 106 may include a pair of pins 106 (FIG. 5A) and boxes 16 for each conductor 21 (FIG. 4A, three shown) of the cable 20. A suitable wet matable connector is discussed and illustrated U.S. Pat. Pub. No. 2011/0024104, which is herein incorporated by reference in its entirety.

The auto-orienter 13, 109 may include a cam 109 (FIG. 5A) and one or more followers 13. As the ESP 100 is lowered into the dock 15, the auto-orienter 13, 109 may rotate the ESP to align the pins 106 with the respective boxes 13. Each of the lander 105 and dock 15 may further include a torque profile, such as splines 107 (FIG. 5A), 18, of a torque profile. Engagement of the splines 107, 18 may torsionally connect the ESP 100 to the production tubing 10*p*. A landing shoulder may be formed at a top of each of the splines 18 to longitudinally support the ESP 100 in the production tubing 10*p*.

The reservoir 6 may be live and shut-in by the closed master 31 and swab 33 valves. The SSV 3 may also be closed. Alternatively, if the dock 15, power cable 20, and control line 11 was not installed with the production tubing 10*p*, a workover rig (not shown) may be used to remove the production tubing, install the dock, power cable, and control line, and reinstall the production tubing. The LARS 1 may then not be needed for the initial installation of the ESP 100 but may be used for later servicing of the ESP.

The wireline truck 70 and crane 90 may be deployed to the wellsite. One or more delivery trucks (not shown) may transport the PCA 40, lubricator 200, ESP 100, and running tools 250*a,b* to the wellsite. The crane 90 may be used to remove the cap 34 from the tree and install the PCA 40 onto the tree.

The wireline truck 70 may include a control room 72, a generator (not shown), a frame 74, a power converter 75, a diplexer (DIX) (not shown), a winch 77 having a deployment cable, such as wireline 80, wrapped therearound, and a boom 78. Alternatively, the deployment cable may be wire rope or slickline or coiled tubing may be used instead of the deployment cable. The control room 72 may include a control console 72*c* and a programmable logic controller (PLC) 72*p*. The generator may be diesel-powered and may supply a one or more phase (i.e., three) alternating current (AC) power signal to the power converter 75. Alternatively, the generator may produce a direct current (DC) power signal. The power converter 75 may include a one or more (i.e., three) phase transformer for stepping the voltage of the AC power signal supplied by the generator from a low voltage signal to an ultra low voltage signal. The power converter 75 may further include a one or more (i.e., three) phase rectifier for converting the ultra low voltage AC signal supplied by the transformer to an ultra low voltage direct current (DC) power signal. The rectifier may supply the ultra low voltage DC power signal to the DIX for transmission to one of the running tools 250*a,b* via the wireline 80.

The PLC 72*p* may receive commands from a control room operator (not shown) via the control console 72*c* and include a data modem (not shown) and multiplexer (not shown) for modulating and multiplexing the commands into a data signal for delivery to the DIX and transmission to one of the running tools 250*a,b* via the wireline 80. The DIX may combine the DC power signal and the data signal into a composite signal and transmit the composite signal to the running tools 250*a,b* via the wireline 80. The DIX may be in electrical communication with the wireline 80 via an electrical coupling (not shown), such as brushes or slip rings, to allow power and data transmission through the wireline while the winch 77 winds and unwinds the wireline. The control console 72*c* may include one or more input devices, such as a keyboard and mouse or trackpad, and one or more video monitors. Alternatively, a touchscreen may be used instead of the monitor and input devices. The PLC 72*p* may also receive data signals from the running tools 250*a,b*, demodulate and demultiplex the data signals, and display the data signals on the monitor of the console 72*c*.

The boom 78 may be an A-frame pivoted to the frame 74 and the LARS 70 may further include a boom hoist (not shown) having a pair of piston and cylinder assemblies. Each piston and cylinder assembly may be pivoted to each beam of the boom and a respective column of the frame. The wireline truck 70 may further include a hydraulic power unit (HPU) 76. The HPU 76 may include a hydraulic fluid reservoir, a hydraulic pump, an accumulator, and one or more control valves for selectively providing fluid communication between the reservoir, the accumulator, and the piston and cylinder assemblies. The hydraulic pump may be driven by an electric motor. The winch 77 may include a drum having the wireline 80 wrapped therearound and a motor for rotating the drum to wind and unwind the wireline. The winch motor may be electric or hydraulic. A sheave may hang from the boom 78. The wireline 80 may extend through the sheave and an end of the wireline may be fastened to a cablehead of the respective running tool 250*a,b*. The HPU 76 may also be connected to the PCA 40 by one or more flexible conduits (not shown).

The wireline truck 70 may further include a visibility fluid unit 71 and a grease unit 73. Each of the units 71, 73 may include a fluid reservoir and a fluid pump. The grease unit reservoir may include grease and may be connected to a grease injector of the lubricator seal head 210 (FIG. 6A) by a flexible conduit (not shown). The visibility fluid unit reservoir may include visibility fluid 71*f* (FIG. 12A) and may be connected to a lubricator valve 220 (FIG. 6A) by a flexible conduit.

The crane 90 may be truck-mounted and have a telescopic boom. Alternatively, the crane may be a crawler, all-terrain, or rough terrain and/or have a fixed boom, such as a lattice or A-frame.

Figure 2:
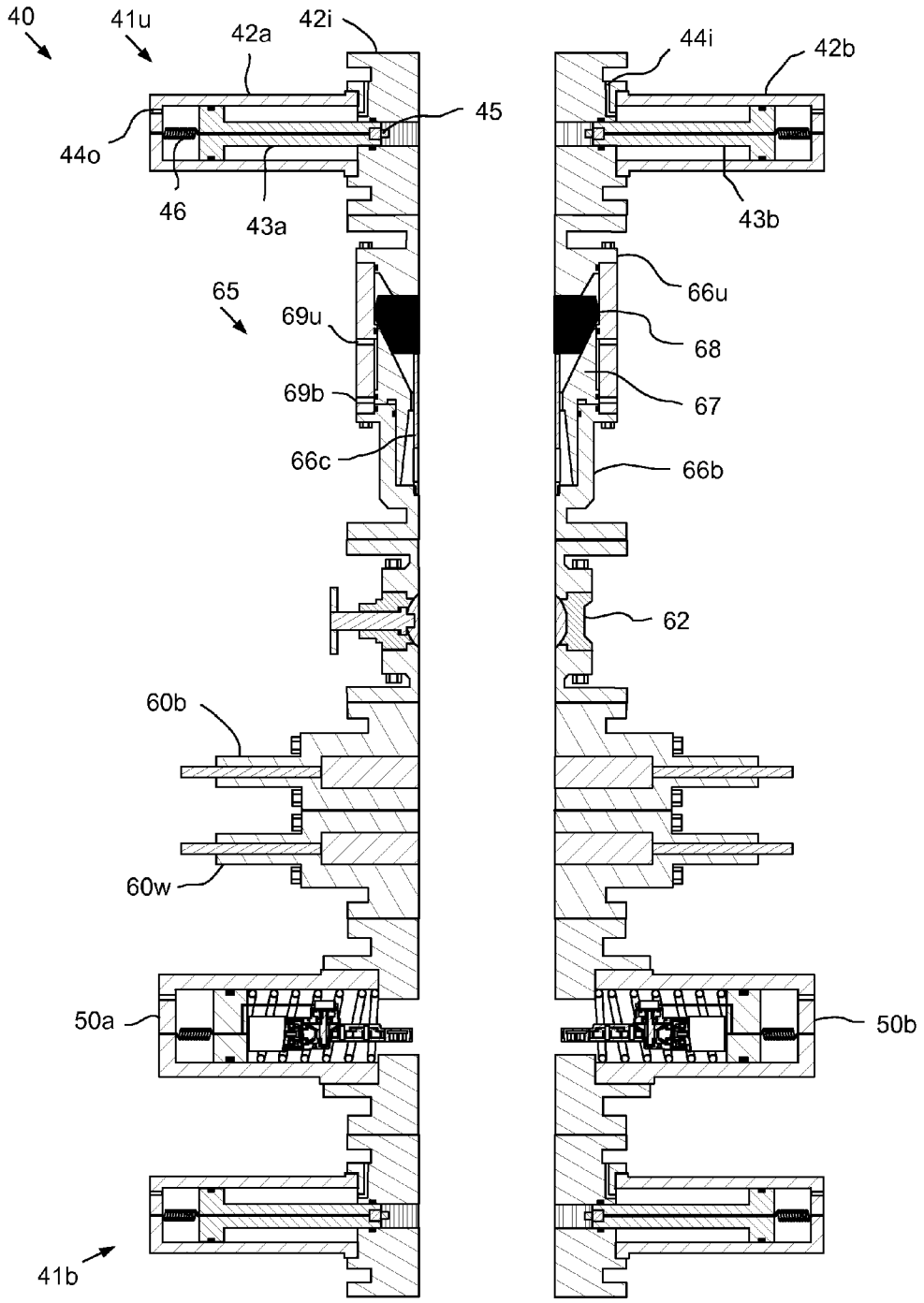
FIG. 2 illustrates a pressure control assembly (PCA) of the LARS.

FIG. 2 illustrates the PCA 40. The PCA 40 may include one or more clamps 41*u,b*, a driver 50, one or more blow out preventers (BOPs) 60, 65 and a shutoff valve 62. Each PCA component may include a housing having a connector, such as a flange, formed at each longitudinal end thereof. The flanges may be connected by fasteners (not shown), such as bolts or studs and nuts. Each PCA housing may have a bore therethrough corresponding to a bore of the production tubing 10*p*.

Figure 8A:
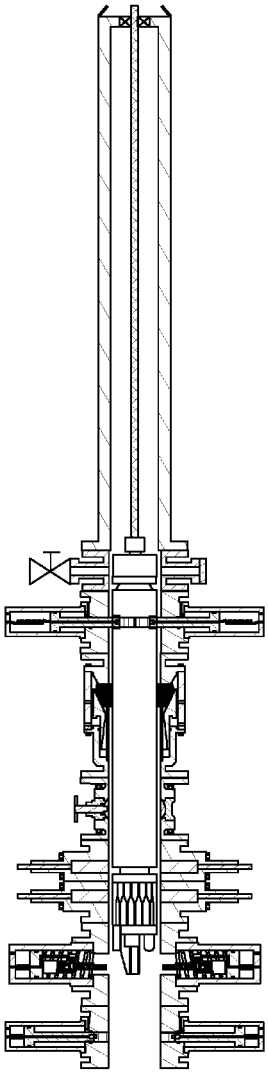

Each clamp 41*u,b* may include a housing 42*a,b,i* having an annular inner portion 42*i* and a pair of outer portions 42*a,b* connected to the inner portion, such as by a threaded connection or flanges. Passages may be formed through the inner portion 42*i* corresponding to each outer portion. An arm 43*a,b* may be disposed in each outer portion. Each arm 43*a,b* may have a piston formed at an outer end thereof and a band formed at an inner end thereof. Each band may be U-shaped. Each arm 43*a,b* may be radially moveable between a disengaged position (shown) and an engaged position (FIG. 8A). The piston may divide each outer portion 42*a,b* into a pair of chambers. An inner port 44*i* may be formed through a wall of the inner housing portion 42*i* corresponding to each outer housing portion 42*a,b* and an outer port 44*o* may be formed through each outer portion. Each port 44*i,o* may be connected to the HPU 76 by the flexible conduits. A proximity sensor, such as a contact switch 45, may be connected to each arm 43*a,b* at a base of the respective band. Leads 46 may connect each contact switch to the PLC 72*p* and may be flexible to accommodate movement of the arms 43*a,b*. In operation, the arms 43*a,b* may be engaged by supplying pressurized hydraulic fluid to the arm piston via outer ports 44*o* and returning hydraulic fluid from the inner ports 44*i*, thereby moving the arms inward in opposing fashion. The arms 43*a,b* may be moved until the bands engage a corresponding profile, such as groove 102 (FIG. 5A), formed in an outer surface of the ESP 100, thereby longitudinally connecting the ESP to the PCA 40. Engagement of the bands may be detected by operation of the contact switches 45. Each clamp 41*u,b* may be locked in the engaged position hydraulically. Disengagement of the arms 43*a,b* may be accomplished by reversing the hydraulic flow.

Alternatively, each clamp may be manually actuated, such as by jack screws, instead of being hydraulically actuated. The jack screws may each include a visual indicator instead of or in addition to the contact switches. The jack screws may each further include a lockout or self-locking threads.

Alternatively, each clamp may include a spider having slips, a bowl, and an actuator operable to longitudinally move the spider along the bowl, thereby also moving the slips radially into or out of the clamp bore. Additionally, the alternative clamp may be used as a backup for each clamp.

The shutoff valve 62 may be manually operated. Alternatively, the shutoff valve 62 may include an actuator (not shown), such as a hydraulic actuator connected to the HPU 76 by the flexible conduits. The BOPs 60, 65 may include one or more ram preventers 60*b,w*, such as a blind ram preventer 60*b*, a wireline ram preventer 60*w*, and an annular preventer 65. The blind ram preventer 60*b* may be capable of cutting the wireline 80 when actuated and sealing the bore. The wireline preventer 60*w* may be capable of sealing against an outer surface of the wireline 80 when actuated.

Additionally, the PCA 40 may include a second annular BOP (not shown) and/or a second isolation valve (not shown) for redundancy. Although shown disposed between the isolation valve 62 and the driver 50, the ram preventers 60 may be disposed at any location along the PCA, such as below the lower clamp 41*b*. Although shown disposed between the upper clamp 41*u* and the isolation valve 62, the annular BOP 65 may be disposed at any location along the PCA.

The annular BOP 65 may include a housing 66*u,b,c*, a piston 67, and an annular packing 68. The annular BOP 65 may be the conical type (shown) or the spherical type (not shown). The housing 66*u,b,c* may include upper 66*u* and lower 66*b* portions fastened together, such as with a flanged connection or locking segments and a locking ring. The piston 67 may be disposed in the housing 66*u,b,c* and movable upwardly in a chamber in response to fluid pressure exertion upwardly against a lower piston face via hydraulic port 69*b*. Movement of the piston 67 may constrict the packing 68 via engagement of an inner cam surface of the piston with an outer surface of the packing 68. The engaging piston and packing surfaces may be frusto-conical and flared upwardly. The packing 68, when sufficiently radially inwardly displaced, may sealingly engage (FIG. 8A) an outer surface of the ESP 100 extending longitudinally through the housing 66*u,b,c*. In the absence of any component disposed through the housing 66*u,b,c*, the packing 68 may completely close off the housing bore, when the packing 68 is sufficiently constricted by piston 67.

Upon downward movement of the piston 67 in response to fluid pressure exertion against an upper piston face via hydraulic port 69*u*, the packing 68 may expand radially outwardly to the disengaged position (as shown). An outer surface of the piston 67 may be annular and may move along a corresponding annular inner surface of the housing 66*u,b,c*. The packing 68 may be longitudinally confined by an end surface of the housing 66*u,b,c*. The packing 68 may be made from a polymer, such as an elastomer, such as natural or nitrile rubber. Additionally, the packing 68 may include metal or alloy inserts (not shown) generally circularly spaced about a longitudinal axis thereof. The inserts may include webs that extend longitudinally through the elastomeric material. The webs may anchor the elastomeric material during inward compressive displacement or constriction of the packing 68.

Additionally, the PCA 40 may further include one or more pressure sensors (not shown) distributed therealong. A first pressure sensor may be disposed below the ram preventers 60 and be in fluid communication with the PCA bore. A second pressure sensor may be disposed between the upper clamp and the annular BOP 65 and be in fluid communication with the PCA bore. The pressure sensors may be in data communication with the PLC 72*p* via a data cable. The pressure sensors may also measure temperature or the PCA may further include one or more pressure sensors distributed therealong.

Additionally, the PCA 40 may further include one or more ports distributed therealong and in fluid communication with the PCA bore. The ports may be used for bleeding pressure and/or injection of fluid. For example, a visibility sub (not shown) may be disposed between the driver 50 and the ram preventers 60. The visibility sub may have a port for connection to the visibility fluid unit. The visibility sub may include a manifold ring having nozzles disposed therearound for spraying visibility fluid into the PCA bore.

Alternatively, a pipe ram preventer or inflatable packer may be used instead of the annular BOP to seal against an outer surface of the ESP 100.

Figure 3A:
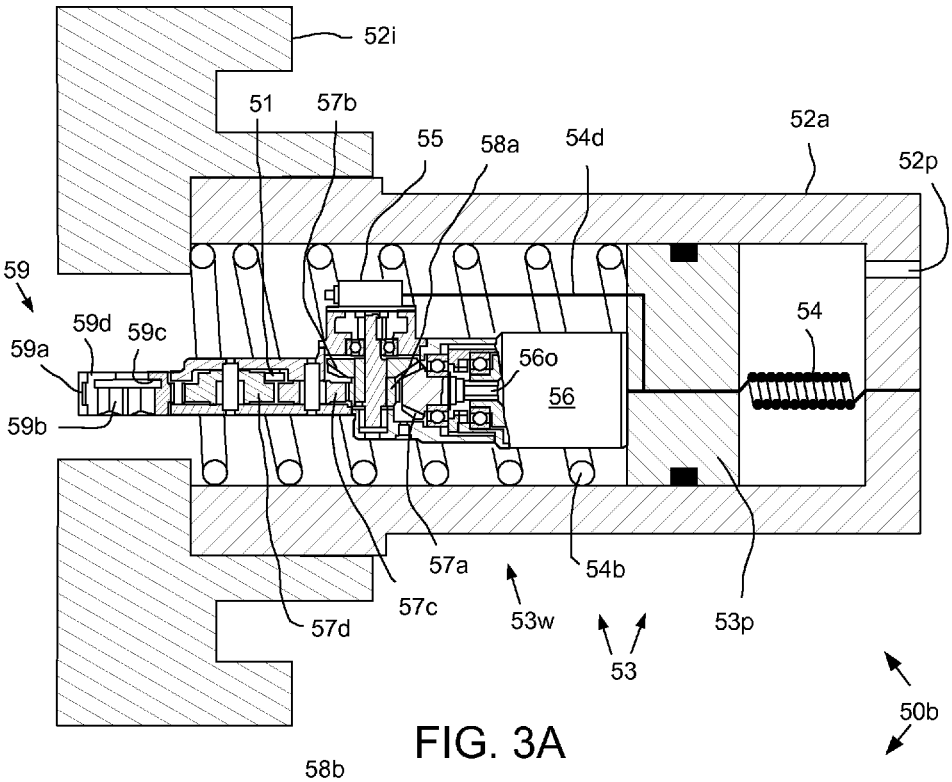
FIGS. 3A and 3B illustrate a unit of a driver of the PCA.
Figure 3B:
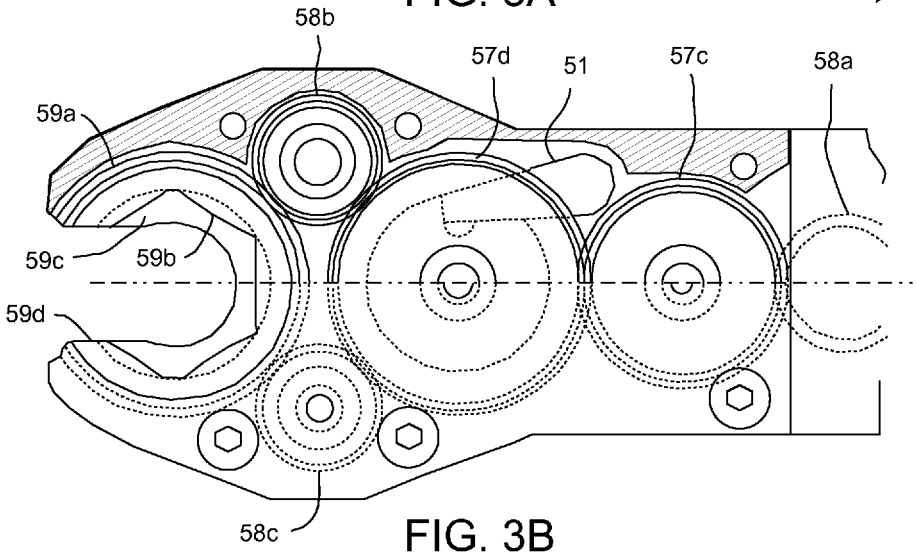

FIGS. 3A and 3B illustrate a unit 50*b* of the driver 50. The driver 50 may include one or more units 50*a,b*. The driver 50 may include a housing 52*a,i* having an annular inner portion 52*i* and an outer portion 52*a* for each unit 50*a,b* connected to the inner portion, such as by a threaded connection or flanges. Passages may be formed through the inner portion 52*i* corresponding to each outer portion 52*a*. An arm assembly 53 may be disposed in each outer portion 52*a*. Each arm assembly 53 may include a piston 53*p* and a wrench 53*w* connected to the piston, such as by a flanged connection. Each arm assembly 53 may be radially moveable between a disengaged position (shown) and an engaged position (FIG. 12C). The piston 53*p* may divide each outer portion 42*a,b* into a chamber and a recess. A port 52*p* may be formed through each outer portion 52*a*. Each port 52*a* may be connected to the HPU 76. An umbilical 54 may connect each contact switch to the wireline truck 70. The umbilical may include one or more conduits and/or cables, such as one or more power fluid conduits 54*p* and a data cable 54*d*. The power fluid may be hydraulic fluid and the power fluid conduits 54*p* may be connected to the HPU 76. The data cable 54*d* may be connected to the PLC 72*p* and may provide data communication between one or more sensors 55 and the PLC. Alternatively, the power fluid may be a gas or the wrench may be electrically driven.

Each wrench 53*w* may include a motor 56, a reduction gear box 51, 57*a-d*, 58*a-c*, the sensors 55, and a socket 59. An output shaft 560 of the motor 56 may be connected with a bevel gear 57*a* which may mesh with another bevel gear 57*b* which may be integral with a pinion 58*a*. The pinion 58*a* may mesh with a gear 57*c* which in turn may mesh with a gear 57*d*. The gear 57*d* may mesh with two pinions 58*b,c* which in turn may mesh with an external gear 59*a* which may be formed around the outer periphery of a socket 59. The gear box 51, 57*a-d*, 58*a-c* may further include a body, one or more shafts, and one or more bearings to support rotation of the gears 57*a-d*, shafts, and pinions 58*a-c* relative to the body. The body may include one or more segments connected together, such as by fastening.

The arrangement may be such that if the pinion 58*a* rotates counterclockwise, as viewed in FIG. 3B, the socket 59 may also rotate counterclockwise, and if the pinion 58*a* rotates clockwise, the socket 59 may also rotate clockwise. The socket 59 may include the external gear 59*a*, a hexagonal portion 59*b* and a bottom wall 59*c*, and may be formed with a cutout or opening 59*d*.

A ratchet 51 may be arranged such that when the socket 59 rotates in a direction opposite to a direction in which a bolt 131 is tightened, it engages with the gear 57*d* and stops this rotation of the socket 59 when the socket 59 comes to a receptive position where the opening 59*d* faces to the left as viewed in FIG. 3B. When fluid pressure is supplied to one port of the motor 56, the output shaft 56*o* may rotate clockwise as viewed from the left in FIG. 3A. This clockwise rotation of the output shaft 56*o* may be transmitted via the gears 57*a-d* to the socket 59, causing the socket 59 to rotate in the bolt tightening direction, such as in counterclockwise direction as viewed in FIG. 3B. Since the output shaft 56*o* may rotate continuously, the socket 59 may rotate continuously in the bolt tightening direction. When fluid pressure is supplied to the other port of the motor 56, the output shaft 56*o* may rotate in the opposite direction and thus the socket 59 may tend to rotate in the opposite direction. Since the gears 57*d* and 59*a* may be substantially identical to each other, the reverse rotation of the socket 59 may be stopped at the central receptive position as illustrated in FIG. 3B because the ratchet 51 may engage with the gear 57*d* before the gear 57*d* makes a full turn during its reverse rotation.

The sensors 55 may include a video camera, a turns counter, and/or a torque sensor. The turns counter may measure an angle of rotation of the bevel gear 57*b* and thus an angle of rotation of the socket 59. The torque sensor may include a strain gage (not shown) disposed on a shaft of the bevel gear 57*b*/pinion 58*a*. The video camera may be monochrome or color, standard definition, enhanced definition, high definition, or low light. The video camera may face the socket 59 to facilitate engagement of the wrench 53*w* with a bolt 131 (FIG. 5D) by the control room operator and may be fixed or have panning and tilting capability. The video camera may further include one or more lights. The lights may include one or more of Hydrargyrum medium-arc iodide (HMI) lights, high intensity discharge (HID) lights, quartz halogen, high intensity light emitting diode (LED) and/or strobe lights.

In operation, the clear visibility fluid 71*f* (FIG. 12A) may be pumped into the PCA bore. The arms 53 may be engaged with respective bolts 131 by supplying pressurized hydraulic fluid to the arm pistons 53*p* via ports 52*p*, thereby moving the arms inward in opposing fashion. The arm assemblies 53 may be moved synchronously or independently by the control room operator. The control room operator may watch video of the sockets 59 on the display of the control console 72*c* to facilitate engagement of the sockets 59 with the bolts 131. The arm assemblies 53 may be moved until the sockets 59 engage the bolts 131. The wrenches 53*w* may be operated to tighten the bolts 131. Torque and turns may be monitored to control tightening. A biasing member, such as a coil spring 54*b*, may be disposed between the inner housing 52*i* and each piston 53*p* to disengage the arm assemblies 53 from the bolts (while relieving pressure from the ports 52*p*). Additionally, each unit 50*a,b* of the driver may include a visibility fluid nozzle directed at the video camera for cleaning thereof or the manifold ring (discussed above) may include one or more nozzles directed at the video camera for cleaning thereof.

Additionally or alternatively to the video camera, the driver may have one or more windows (not shown) connected to the inner housing 52*i*. The windows may be positioned to allow manual viewing of engagement of the wrenches with the bolts. The windows may be made from a transparent polymer, ceramic, or composite, such as polycarbonate (PC), polymethyl methacrylate (PMMA), tempered glass, laminated glass, aluminium oxynitride, magnesium aluminate spinel, or aluminum oxide. The windows may be mounted on window frames an adhesive or fasteners. The window frames may be formed in or attached to the inner housing, such as by welding.

Alternatively, the driver may include a rotary table (not shown) operable to rotate each unit relative to the inner housing portion. The inner housing portion may be modified to enclose the units. The rotary table may include a stator connected to the modified inner housing portion, a rotor connected to each outer housing portion, a motor for rotating the rotor relative to the stator, a swivel for providing fluid and data communication between the wireline truck 70 and each wrench, and a bearing for supporting the rotor from the stator. Alternatively, the driver with the rotary table may only include one driver unit.

Figure 4A:
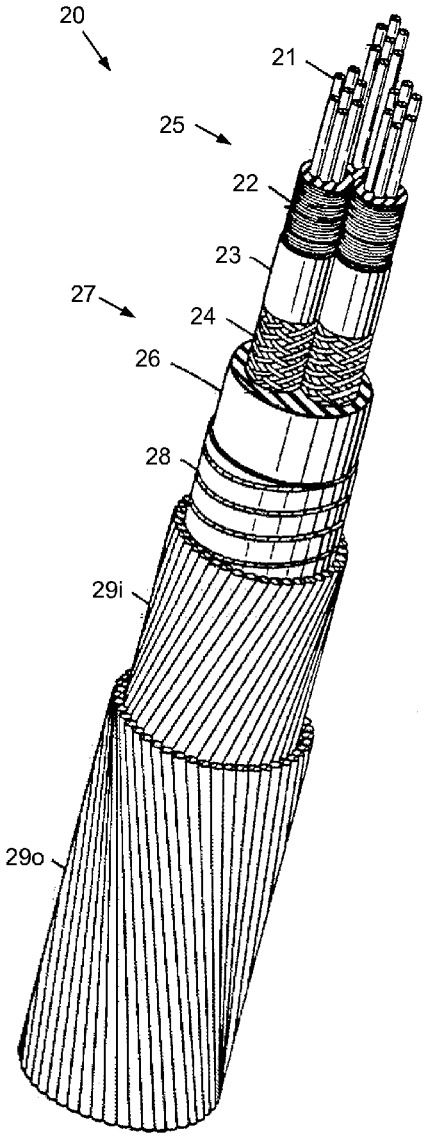
FIG. 4A illustrates a power cable of an artificial lift system (ALS).

FIG. 4A illustrates the power cable 20. The cable 20 may include a core 27 having one or more (three shown) wires 25 and a jacket 26, and one or more layers 29*i,o* of armor. Each wire 25 may include a conductor 21, a jacket 22, a sheath 23, and bedding 24. The conductors 21 may each be made from an electrically conductive material, such as aluminum, copper, or alloys thereof. The conductors 21 may each be solid or stranded. Each jacket 22 may electrically isolate a respective conductor 21 and be made from a dielectric material, such as a polymer (i.e., ethylene propylene diene monomer (EPDM)). Each sheath 23 may be made from lubricative material, such as polytetrafluoroethylene (PTFE) or lead, and may be tape helically wound around a respective wire jacket 22. Each bedding 24 may serve to protect and retain the respective sheath 23 during manufacture and may be made from a polymer, such as nylon. The core jacket 26 may protect and bind the wires 25 and be made from a polymer, such as EPDM or nitrile rubber.

The armor 29*i,o* may be made from one or more layers 29*i,o* of high strength material (i.e., tensile strength greater than or equal to one hundred, one fifty, or two hundred kpsi). The high strength material may be a metal or alloy and corrosion resistant, such as galvanized steel, aluminum, or a polymer, such as a para-aramid fiber. The armor 29*i,o* may include two contra-helically wound layers 29*i,o* of wire, fiber, or strip. Additionally, a buffer (not shown) may be disposed between the armor layers 29*i,o*. The buffer may be tape and may be made from the lubricative material. Additionally, the cable 20 may further include a pressure containment layer 28 made from a material having sufficient strength to contain radial thermal expansion of the core 27 and wound to allow longitudinal expansion thereof. Alternatively, the power cable 20 may be flat.

Figure 4B:
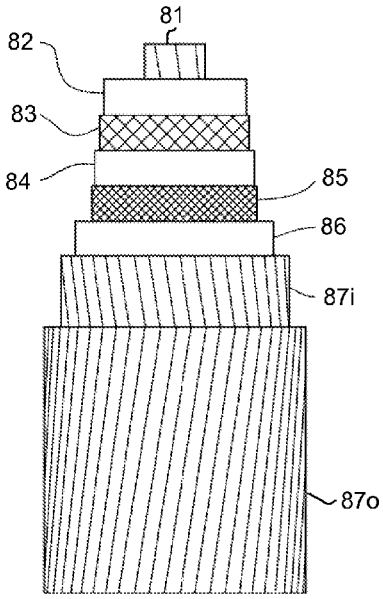
FIGS. 4B and 4C illustrate a wireline of the LARS.
Figure 4C:
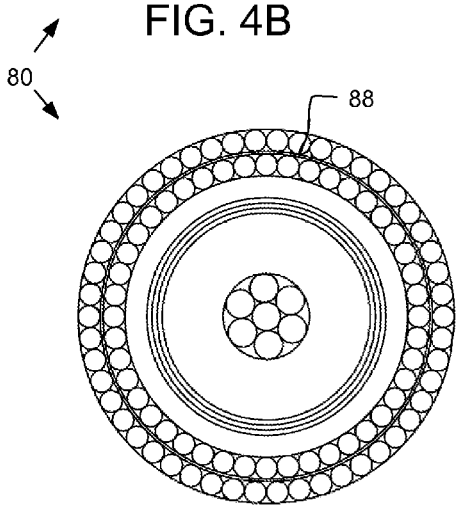

FIGS. 4B and 4C illustrates the wireline 80. The wireline 80 may include an inner core 81, an inner jacket 82, a shield 83, an outer jacket 86, and one or more layers 87*i,o* of armor. The inner core 81 may be the first conductor and made from an electrically conductive material, such as aluminum, copper, or alloys thereof. The inner core 81 may be solid or stranded. The inner jacket 82 may electrically isolate the core 81 from the shield 83 and be made from a dielectric material, such as a polymer (i.e., polyethylene). The shield 83 may serve as the second conductor and be made from the electrically conductive material. The shield 83 may be tubular, braided, or a foil covered by a braid. The outer jacket 86 may electrically isolate the shield 83 from the armor 87*i,o* and be made from a fluid-resistant dielectric material, such as polyethylene or polyurethane. The armor 87*i,o* may be made from one or more layers 87*i,o* of high strength material (i.e., tensile strength greater than or equal to one hundred, one fifty, or two hundred kpsi) to support the ESP 100 and the lubricator. The high strength material may be a metal or alloy and corrosion resistant, such as galvanized steel, aluminum, or a polymer, such as a para-aramid fiber. The armor 87*i,o* may include two contra-helically wound layers 87*i,o* of wire, fiber, or strip.

Additionally, the wireline 80 may include a sheath 85 disposed between the shield 83 and the outer jacket 86. The sheath 85 may be made from lubricative material, such as polytetrafluoroethylene (PTFE) or lead, and may be tape helically wound around the shield 83. If lead is used for the sheath 85, a layer of bedding 84 may insulate the shield 83 from the sheath and be made from the dielectric material. Additionally, a buffer 88 may be disposed between the armor layers 87*i,o*. The buffer 88 may be tape and may be made from the lubricative material.

FIGS. 5A-5D illustrate the ESP 100. The ESP 100 may include the lander 105, an electric motor 110, a shaft seal 115, the inlet 120, a pump having one or more sections 125, 135, and an isolation device 140. Housings 110*h*-135*h* of each of the ESP components may be longitudinally and torsionally connected, such as by flanged connections 101, 130*u,b*. Shafts 110*s*-135*s* of the motor 110, shaft seal 115, inlet 120, and pump stages 125, 135 may be torsionally connected, such as by shaft couplings 103. Alternatively, the housings 110*h*-135*h* may be connected by threaded connections.

The flanged connection 130*u,b* may include an upper flange 130*u* connected to the pump section housing 135*h*, such as by a weld or a threaded connection, and a lower flange 130*b* connected to the pump section housing 135*h*, such as by a weld or a threaded connection. The flanged connection 130*u,b* may include an auto orienting profile 132 having mating portions formed in each flange 130*u,b*. The upper flange 130*u* may have passages formed therethrough for receiving one or more threaded fasteners, such as bolts 131. The passage may receive a shaft of each bolt 131 and a head of the bolt may engage an upper surface of the flange 130*u* when the shaft is inserted through the passage. A lower end of the section housing 135*h* may serve as a trap for the bolts 131, thereby preventing escape of the bolts 131 during insertion of the section housing into the PCA 40. To trap the bolts 131, the bolts may be disposed in the passages before the upper flange 130*u* is connected to the section housing 135*h*. The lower flange 130*b* may have threaded sockets 133 for receiving threaded shafts of respective bolts 131, thereby forming the flanged connection 130*u,b*. The passages and sockets 133 may be equally spaced around the respective flanges 130*u,b* at a predetermined increment, such as ninety degrees for four, sixty degrees for six, or forty-five degrees for eight.

The flanged connection 130*u,b* may further include a temporary connection for each flange 130*u,b*, such as shearable fasteners 134. One of the shearable fasteners 134 may torsionally connect the upper shaft coupling 103 of the first pump section 125 to the lower flange 130*b* and another one of the shearable fasteners 134 may torsionally connect the upper shaft coupling 103 of the second pump section 135 to the upper flange 130*u*. The shaft couplings 103 may be temporarily fastened in mating positions such that when the auto-orienting profile aligns the flanges 130*u,b*, the shaft couplings 103 may also be aligned. The shearable fasteners 134 may fracture in response to operation of the motor 110 once the ESP has landed in the dock.

Alternatively, instead of using the shearable fasteners 134 for shaft coupling alignment, each shaft coupling 103 may have an auto-orienting profile.

The motor 110 may be filled with a dielectric, thermally conductive liquid lubricant, such as motor oil. The motor 110 may be cooled by thermal communication with the production fluid 7. The motor 110 may include a thrust bearing (not shown) for supporting the drive shaft 110*s*. In operation, the motor 110 may rotate the drive shaft 110*s*, thereby driving the pump shafts 125*s*, 135*s* of the pump 125, 135. The drive shaft 110*s* may be directly drive the pump shaft 125*s*, 135*s* (no gearbox).

The motor 110 may be an induction motor, a switched reluctance motor (SRM) or a permanent magnet motor, such as a brushless DC motor (BLDC). Additionally, the ESP 100 may include a second (or more) motor for tandem operation with the motor 110. The induction motor may be a two-pole, three-phase, squirrel-cage induction type and may run at a nominal speed of thirty-five hundred rpm at sixty Hz. The SRM motor may include a multi-lobed rotor made from a magnetic material and a multi-lobed stator. Each lobe of the stator may be wound and opposing lobes may be connected in series to define each phase. For example, the SRM motor may be three-phase (six stator lobes) and include a four-lobed rotor. The BLDC motor may be two pole and three phase. The BLDC motor may include the stator having the three phase winding, a permanent magnet rotor, and a rotor position sensor. The permanent magnet rotor may be made of one or more rare earth, ceramic, or cermet magnets. The rotor position sensor may be a Hall-effect sensor, a rotary encoder, or sensorless (i.e., measurement of back EMF in undriven coils by the motor controller).

The shaft seal 115 may isolate the reservoir fluid 7 being pumped through the pump 125, 135 from the lubricant in the motor 110 by equalizing the lubricant pressure with the pressure of the reservoir fluid 7. The shaft seal 115 may house a thrust bearing (not shown) capable of supporting thrust load from the pump 125, 135. The shaft seal 115 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump inlet 120 may be standard type, static gas separator type, or rotary gas separator type depending on the gas to oil ratio (GOR) of the production fluid 7. The standard type inlet may include a plurality of ports 121 allowing reservoir fluid 7 to enter a lower or first section 125 of the pump 125, 135. The standard inlet may include a screen (not shown) to filter particulates from the reservoir fluid 7. The static gas separator type may include a reverse-flow path to separate a gas portion of the reservoir fluid 7 from a liquid portion of the reservoir fluid.

The isolation device 140 may have one or more fixed seals received by a polished bore receptacle 17 of the dock 15, thereby isolating discharge ports (not shown) of the isolation device 140 from the pump inlet 120. The isolation device 140 may further include a latch (not shown) operable to engage a latch profile (not shown) of the dock 15, thereby longitudinally connecting the ESP 100 to the production tubing 10*p*. The isolation device 140 may further include a threaded inner profile for engagement with the running tool 250*b*. Additionally, the isolation device 140 may include a bypass vent (not shown) for releasing gas separated by the pump inlet 120 that may collect below the isolation device and preventing gas lock of the pump 125, 135. A pressure relief valve (not shown) may be disposed in the bypass vent.

The pump 125, 135 may be centrifugal or positive displacement. The centrifugal pump may be a radial flow or mixed axial/radial flow. The positive displacement pump may be progressive cavity. Each section 125, 135 of the centrifugal pump may include one or more stages, each stage having an impeller and a diffuser. The impeller may be torsionally and longitudinally connected to the respective pump shaft 125*s*, 135*s*, such as by a key. The diffuser may be longitudinally and torsionally connected to a housing of the pump, such as by compression between a head and base screwed into the housing. Rotation of the impeller may impart velocity to the reservoir fluid 7 and flow through the stationary diffuser may convert a portion of the velocity into pressure. The pump 125, 135 may deliver the pressurized reservoir fluid 7 to the isolation device bore.

Alternatively, the pump 125, 135 may include one or more sections of a high speed compact pump discussed and illustrated at FIGS. 1C and 1D of U.S. patent application Ser. No. 12/794,547, filed Jun. 4, 2010, which is herein incorporated by reference in its entirety. High speed may be greater than or equal to ten thousand, fifteen thousand, or twenty thousand revolutions per minute (RPM). Each compact pump section may include one or more stages, such as three. Each stage may include a housing, a mandrel, and an annular passage formed between the housing and the mandrel. The mandrel may be disposed in the housing. The mandrel may include a rotor, one or more helicoidal rotor vanes, a diffuser, and one or more diffuser vanes. The rotor may include a shaft portion and an impeller portion. The rotor may be supported from the diffuser for rotation relative to the diffuser and the housing by a hydrodynamic radial bearing formed between an inner surface of the diffuser and an outer surface of the shaft portion. The rotor vanes may interweave to form a pumping cavity therebetween. A pitch of the pumping cavity may increase from an inlet of the stage to an outlet of the stage. The rotor may be longitudinally and torsionally connected to the motor drive shaft and be rotated by operation of the motor. As the rotor is rotated, the production fluid 7 may be pumped along the cavity from the inlet toward the outlet. The annular passage may have a nozzle portion, a throat portion, and a diffuser portion from the inlet to the outlet of each stage, thereby forming a Venturi.

Additionally, the ESP 100 may further include a sensor sub (not shown). The sensor sub may be employed in addition to or instead of the sensors 4*u,b*. The sensor sub may include a controller, a modem, a diplexer, and one or more sensors (not shown) distributed throughout the ESP 100. The controller may transmit data from the sensors to the motor controller via conductors 21 of the cable 20. Alternatively, the cable 20 may further include a data conduit, such as data wires or optical fiber, for transmitting the data. A PT sensor may be in fluid communication with the reservoir fluid 7 entering the pump inlet 120. A GOR sensor may also be in fluid communication with the reservoir fluid 7 entering the pump inlet 104*i*. A second PT sensor may be in fluid communication with the reservoir fluid 7 discharged from the pump outlet/ports 1060. A temperature sensor (or PT sensor) may be in fluid communication with the lubricant to ensure that the motor 101 is being sufficiently cooled. A voltage meter and current (VAMP) sensor may be in electrical communication with the cable 20 to monitor power loss from the cable. Further, one or more vibration sensors may monitor operation of the motor 110, the pump 125, 135, and/or the shaft seal 115. A flow meter may be in fluid communication with the pump outlet for monitoring a flow rate of the pump 125, 135. Alternatively, the tree 30 may include a flow meter (not shown) for measuring a flow rate of the pump 125, 135 and the tree flow meter may be in data communication with the motor controller.

The control unit 39 may include a power source, such as a generator or transmission lines, and a motor controller for receiving an input power signal from the power source and outputting a power signal to the motor 110 via the power cable and the connector 105. For the induction motor, the motor controller may be a switchboard (i.e., logic circuit) for simple control of the motor 110 at a nominal speed or a variable speed drive (VSD) for complex control of the motor. The VSD controller may include a microprocessor for varying the motor speed to achieve an optimum for the given conditions. The VSD may also gradually or soft start the motor, thereby reducing start-up strain on the shaft and the power supply and minimizing impact of adverse well conditions.

For the SRM or BLDC motors, the motor controller may sequentially switch phases of the motor, thereby supplying an output signal to drive the phases of the motor 110. The output signal may be stepped, trapezoidal, or sinusoidal. The BLDC motor controller may be in communication with the rotor position sensor and include a bank of transistors or thyristors and a chopper drive for complex control (i.e., variable speed drive and/or soft start capability). The SRM motor controller may include a logic circuit for simple control (i.e. predetermined speed) or a microprocessor for complex control (i.e., variable speed drive and/or soft start capability). The SRM motor controller may use one or two-phase excitation, be unipolar or bi-polar, and control the speed of the motor by controlling the switching frequency. The SRM motor controller may include an asymmetric bridge or half-bridge.

Figure 6A:
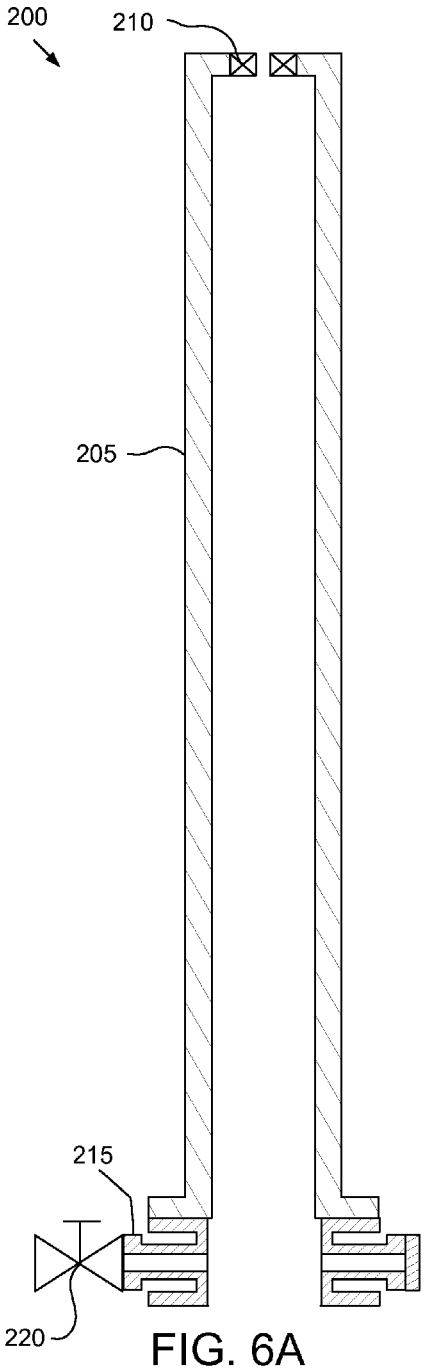
FIG. 6A illustrates a lubricator of the LARS.
Figure 6B:
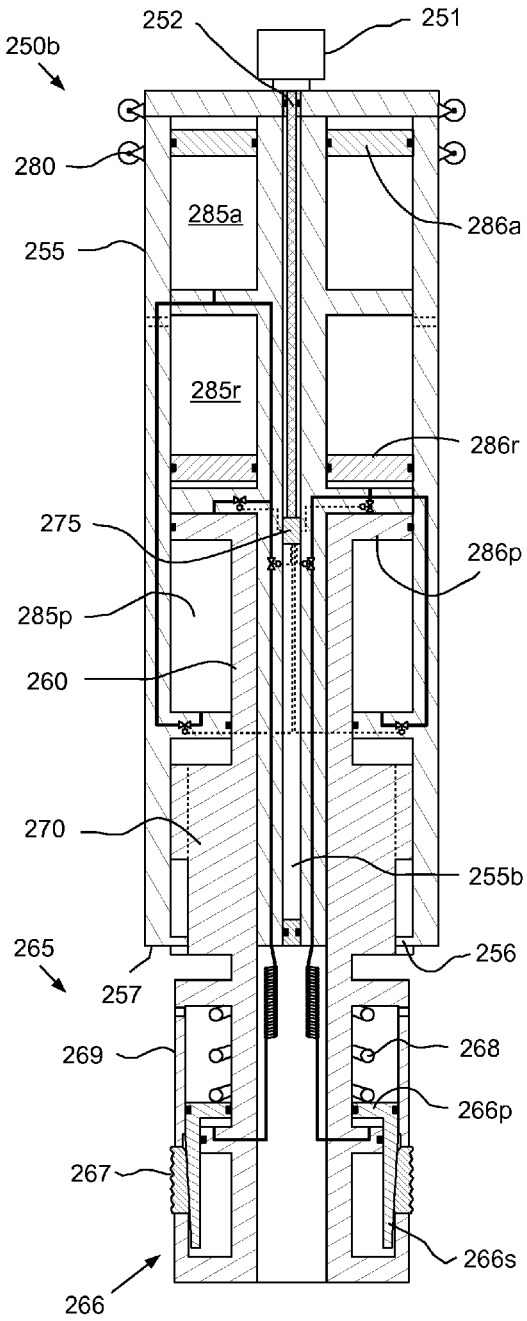
FIG. 6B illustrates a running tool of the LARS.
Figures 7A, 7B, 7C:
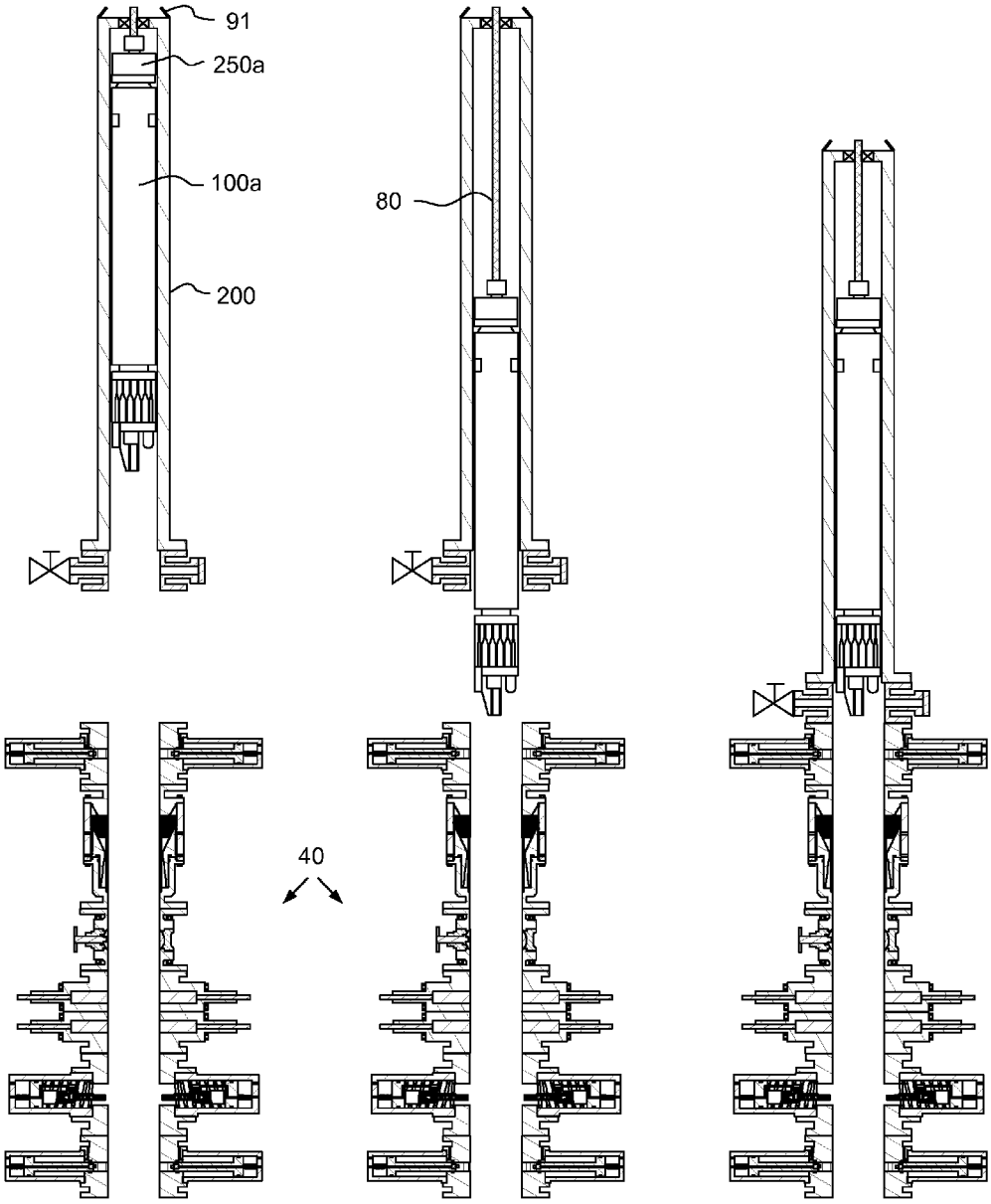

FIG. 6A illustrates the lubricator 200. The lubricator 200 may include a tool housing 205 (aka lubricator riser), a seal head 210, a tee 215, and a shutoff valve 220. Components of the lubricator 200 may be connected, such as by flanged connections. The tee 215 may also have a lower flange for connecting to an upper flange of the upper clamp 41*u*. The seal head 210 may include one or more stuffing boxes and a grease injector. Each stuffing box may include a packing, a piston, and a housing. A port may be formed through the housing in communication with the piston. The port may be connected to the HPU 76 via a hydraulic conduit (not shown). When operated by hydraulic fluid, the piston may longitudinally compress the packing, thereby radially expanding the packing inward into engagement with the wireline 80.

The grease injector may include a housing integral with each stuffing box housing and one or more seal tubes. Each seal tube may have an inner diameter slightly larger than an outer diameter of the wireline 80, thereby serving as a controlled gap seal. An inlet port and an outlet port may be formed through the grease injector/stuffing box housing. A grease conduit (not shown) may connect an outlet of the grease pump with the inlet port and another grease conduit (not shown) may connect the outlet port with the grease reservoir. Alternatively, the outlet port may discharge into a spent fluid container (not shown). Grease (not shown) may be injected from the grease unit 73 into the inlet port and along the slight clearance formed between the seal tube and the wireline 80 to lubricate the wireline, reduce pressure load on the stuffing box packings, and increase service life of the stuffing box packings.

FIG. 6B illustrates one of the running tools 250*b*. The running tool 250*b* may include a cablehead 251, a housing 255, a mandrel 260, a gripper 265, a cam 270, a microcontroller 275, an anti-rotation guide 280, and a stroker 285*a,r,p*, 286*a,r,p*.

The wireline 80 may be longitudinally connected to the cablehead 251 by a shearable connection (not shown). The wireline 80 may be sufficiently strong so that a margin exists between the ESP deployment weight and the strength thereof. For example, if the deployment weight is ten thousand pounds, the shearable connection may be set to fail at fifteen thousand pounds and the wireline may be rated to twenty thousand pounds. The cablehead 251 may further include a fishneck so that if the ESP 100 becomes trapped in the wellbore 5*w*, the wireline 80 may be freed from rest of the components by operating the shearable connection and a fishing tool (not shown), such as an overshot, may be deployed to retrieve the ESP 100. The cablehead 251 may also include leads 252 extending therethrough and into a bore 255*b* of the housing 255. The leads 252 may provide electrical communication between the conductors 81, 83 of the wireline 80 and the microcontroller 275.

The anti-rotation guide 280 may include one or more sets of rollers for engaging an inner surface of the tool housing 205. Each roller may be connected to an outer surface of the housing 255, such as by a base. The rollers and housing 255 may be sized such that the rollers form an interference fit with the tool housing 205. Each set may include a plurality of rollers oriented to rotationally connect the housing 255 to the tool housing 205 while allowing the running tool 250*b* to move longitudinally relative to the tool housing 255. The rollers may be made from a slip-resistant material or include a rim and a tire made from the slip resistant material. The slip resistant material may be a polymer, such as an elastomer or elastomer copolymer. Reaction torque from operation of the cam 270 may be transferred to the tool housing 205 due to the engagement of the rollers with the tool housing. Alternatively, sprockets, drag blocks, or drag springs may be used instead of the rollers.

The housing 255 may be tubular and have an upper end closed by a cap and a lower end open for receiving the mandrel 260. The housing 255 may have a bore 255*b* formed therethrough, an outer wall, and an inner wall extending therealong. The microcontroller 275 may be disposed in the bore 255*b*. An upper end of the bore may receive the cablehead leads 252 and a lower end may be sealed by a balance piston. A dielectric fluid may fill the bore. An annulus may be formed between the housing inner and outer walls. The housing 255 may have a landing shoulder 257 formed in a lower end thereof for receiving an upper end of the isolation device 140.

The housing annulus may be divided by one or more bulkheads, such as into an accumulator partition 285*a*, a reservoir partition 285*r*, and a piston partition 285*p*. Pistons 286*a,r,p* may be disposed in respective partitions 285*a,r,p*. The accumulator piston 286*a* may divide the accumulator partition 285*a* into a hydraulic fluid chamber and a spring chamber. The spring chamber may be filled with a gas, such as nitrogen, and hydraulic fluid may be injected into the hydraulic chamber by the HPU 76 to charge the accumulator 285*a*. The reservoir piston 286*r* may divide the reservoir partition 286*a* into a reservoir fluid chamber and a vent chamber. One or more ports formed through the housing outer wall may provide fluid communication between the vent chamber and an external environment of the running tool 250*b*. Alternatively, the running tool 250*b* may include an HPU or coiled tubing may be used instead of the accumulator.

An upper portion of the mandrel 260 may be disposed in the housing annulus and a lower portion may extend therefrom. The piston 286*p* may be formed at an upper end of the mandrel 260 or the piston may be a separate member connected to the mandrel, such as by a threaded connection (not shown). The mandrel 260 may be longitudinally movable relative to the upper housing by operation of the piston 286*p* between an upper position (shown) and a lower position (FIG. 12B). The piston 286*p* may divide the piston partition 285*p* into an upper piston chamber and a lower piston chamber.

The cam 270 may be engaged with one or more followers 256 formed at the housing lower end. The cam 270 may be formed in an outer surface of the mandrel 260 or be a separate member connected to the mandrel, such as by a threaded connection. The cam 270 may have a profile, such as a slot, formed therearound and extending therealong operable to rotate the mandrel 260 relative to the housing 255 as the mandrel moves longitudinally thereto. The cam profile may be configured to rotate the mandrel 260 by a predetermined increment in response to a longitudinal stroke of the mandrel. The cam increment may be less than or equal to the increment of the flanged connection 130*u,b*. The cam profile may configured to rotate the mandrel by the increment in response to either an upward or downward stroke, a cycle of strokes, or the running tool 250*b* may further include a ratchet (not shown) so that the mandrel 260 is only rotated during one stroke of a cycle. The cam profile may be gradual so that the mandrel 260 may be halted during a stroke. Alternatively, the running tool 250*b* may include a motor for rotating the mandrel 260 instead of the cam 270 and follower 256. The motor may be electric, hydraulic, or pneumatic.

The gripper 265 may include a body 269, a linear actuator 266, one or more fasteners, such as serrated dogs 267. The gripper body 269 may be formed at a lower end of the mandrel 260 or the body may be a separate member connected to the mandrel, such as by a threaded connection (not shown). The gripper body 269 may have a bore formed therethrough, an outer wall and an inner wall extending therealong. An annulus may be formed between the gripper body inner and outer walls. The gripper annulus may be divided by one or more bulkheads into an upper partition and a lower partition. The linear actuator 266 may include a piston 266*p*, a sleeve 266*s*, and a biasing member, such as a coil spring 268. The piston 266*p* and the sleeve 266*s* may be one integral member or separate members connected, such as by a threaded connection (not shown).

The dogs 267 may be radially movable relative to the gripper body 269 between an engaged position (shown) and a disengaged position (not shown). In the engaged position, the dogs 267 may be disposed through respective openings formed through the gripper body outer wall and an outer surface of each dog may be serrated for engaging the threaded inner profile of the isolation device 140. Abutment of each dog 267 against the gripper outer wall surrounding the opening and engagement of each dog serration with the isolation device thread may longitudinally and torsionally connect the gripper 265 and the isolation device 140. Each of the dogs 267 may be an arcuate segment, may include a lip (not shown) formed at each longitudinal end thereof and extending from the inner surface thereof, and have an inclined inner surface. A dog spring (not shown) may disposed between each lip of each dog 267 and the gripper body outer wall, thereby radially biasing the dog inward away from the gripper body outer wall.

The gripper piston 266*p* may divide the upper gripper partition into a hydraulic fluid chamber and a spring chamber. One or more ports formed through the gripper body outer wall may vent the spring chamber to an external environment of the running tool 250*b*. The piston/sleeve 266*p,s* may be longitudinally movable relative to the gripper body 269 between the engaged and disengaged positions. The spring 268 may be disposed in the spring chamber and act against the piston 268 and the gripper body 269, thereby biasing the piston/sleeve 266*p,s* into engagement with the dogs 267. The sleeve 266*s* may have a conical outer surface and an inner surface of each dog 267 may have a corresponding inclination.

The running tool 250*b* may further have one or more hydraulic circuits providing selective fluid communication among the accumulator 285*a*, reservoir 285*r*, piston partition 285*p*, and gripper 266. Each hydraulic circuit may include a passage formed in the housing walls and/or the partitions and a control valve. The control valves may be in electrical communication with the microcontroller 275 for operation thereof. The hydraulic circuits for the gripper may each further have a flexible conduit for accommodating longitudinal movement thereof.

Additionally, the running tool 250*b* may include downhole tractor (not shown) to facilitate the delivery of the ESP 100, especially for highly deviated wells, such as those having an inclination of more than forty-five degrees or dogleg severity in excess of five degrees per one hundred feet. The drive and wheels of the tractor may be collapsed against the wireline and deployed when required by a signal from the surface.

FIGS. 7A-14C illustrate insertion of the ESP 100 into the wellbore 5*w* using the LARS 1. Referring to FIG. 7A, to prepare for insertion, the ESP 100 may be assembled into two or more deployment sections 100*a-d*. The first deployment section 100*a* may include the motor 110 and the lander 105. The second deployment section 100*b* (FIG. 8C) may include the shaft seal 115. The third deployment section 100*c* (FIG. 10A) may include the inlet 120 and the first pump section 125. The fourth deployment section 100*d* (FIG. 11C) may include the second pump section 135 and the isolation device 140. A length of each deployment section 100*a-d* (plus respective running tool 250*a,b*) may be less than or equal to a length of the tool housing 205*h*. The arrangement and number of deployment sections 100*a-d* may vary based on parameters of the ESP 100, such as number of stages and components.

The wireline 80 may be inserted into the seal head 210 of the lubricator 200 and connected to a cablehead of the running tool 250*a*. The running tool 250*a* may include an electrically operated gripper for connecting to the motor flange 101. Alternatively, the running tool 250*a* may include a flange 101 for connecting to the deployment sections 100*a-c*. The running tool 250*a* may then be connected to the first deployment section 100*a*. The first deployment section 100*a* may be inserted into the tool housing 205. The lubricator 200 may then be connected to the crane 90 via a sling 91. The lubricator 200 and first deployment section 100*a* may be hoisted over the PCA 40 using the wireline 80 and/or the crane 90.

Additionally, the PLC 72*p* may include an interlock (not shown) operable to ensure that the deployment sections are not inadvertently dropped into the wellbore.

Referring to FIG. 7B, the crane 90 may suspend the lubricator 200 while the wireline winch 77 is operated to lower the first deployment section 100*a* until the lander 105 and a lower portion of the motor 110 are accessible. The motor 110 may then be serviced, such as by adding motor oil thereto. Referring to FIG. 7C, the lubricator 200 may be lowered onto the PCA 40 using the crane 90. The lubricator tee 215 may then be fastened to the upper clamp 41*u*, such as by a flanged connection. The seal head 210 may be operated to engage the wireline 80. Pressure may be equalized and the lubricator 200 tested. The master 31 and swab 33 valves may then be opened.

Figure 8B:
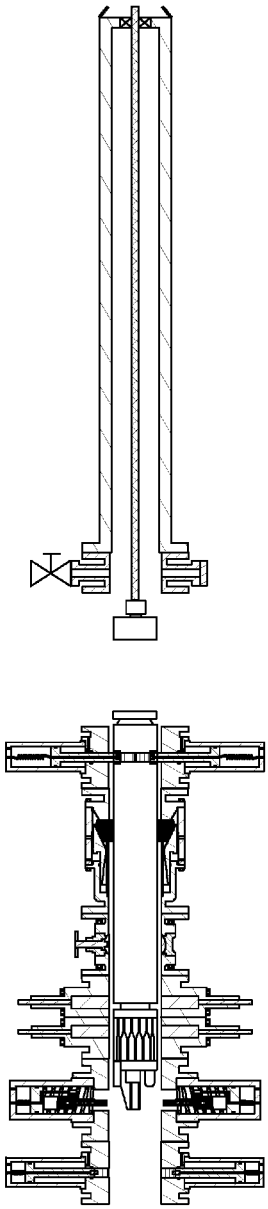
Figure 8C:
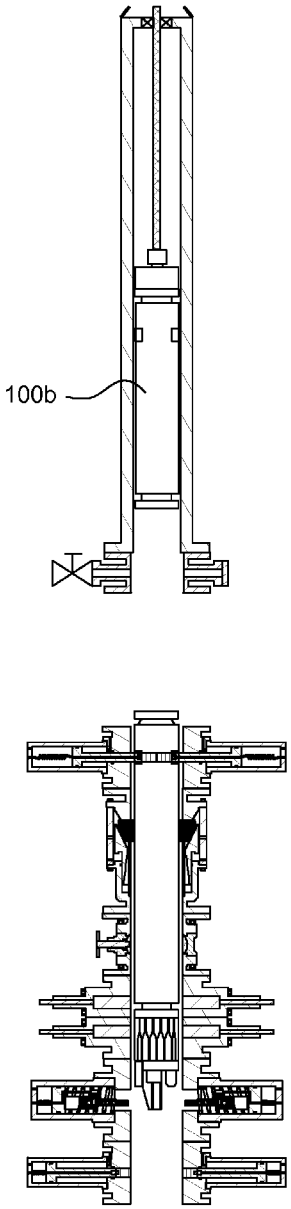

Referring to FIG. 8A, the first deployment section 100*a* may be lowered into the PCA 40 using the wireline 80 until the motor groove 102 is aligned with the upper clamp 41*u*. The upper clamp 41*u* may then be operated to engage the motor 110, thereby supporting the first deployment section 100*a*. The annular BOP 65 may then be operated to engage the packing 68 with an outer surface of the motor 110. Pressure may be bled and the annular BOP 65 tested. Since a bottom of the motor 110 may be sealed, the first deployment section 100*a* may plug a bore of the PCA, thereby sealing an upper portion of the PCA 40 from wellbore pressure. The groove 102 may be located so that the upper motor flange 101 is accessible. Referring to FIG. 8B, pressure in the lubricator 200 may be bled using the valve 220 and the lubricator connection to the PCA 40 may be disassembled. The upper clamp 41*u* may also secure the first deployment section 100*a* from being ejected from the PCA 40 due to wellbore pressure. The running tool 250*a* may be operated to release the first deployment section 100*a* using the wireline 80. The lubricator 200 and running tool 250*a* may then be removed. Referring to FIG. 8C, the second deployment section 100*b* may be inserted into the tool housing 205 and connected to the running tool 250*a*. The lubricator 200 and second deployment section 100*b* may be hoisted over the PCA 40 using the wireline 80 and/or the crane 90.

Figure 9A:
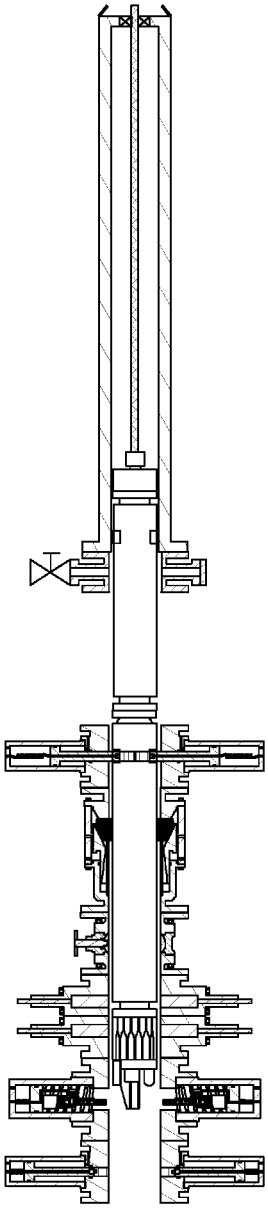
Figure 9B:
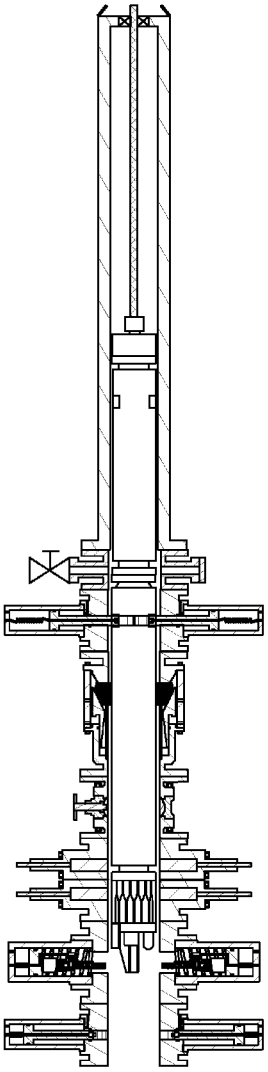
Figure 9C:
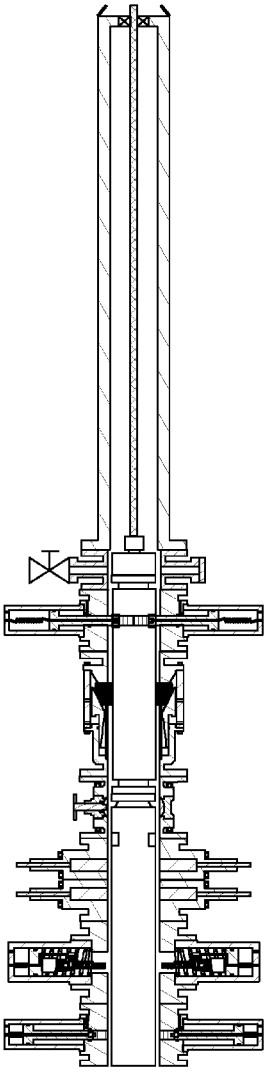

Referring to FIG. 9A, the crane 90 may suspend the lubricator 200 while the wireline winch 77 is operated to lower the second deployment section 100*b* until the lower flange 101 of the shaft seal 115 seats on the upper flange 101 of the motor 110. During lowering, the flanges 101 may be manually aligned and the upper motor shaft coupling 103 may be manually aligned and engaged with the lower seal shaft coupling 103. The flanged connection 101 may be assembled. If necessary, the shaft seal 115 may also be serviced, such as by adding motor oil. Referring to FIG. 9B, the lubricator 200 may be lowered onto the PCA 40 using the crane 90. The lubricator tee 215 may again be fastened to the PCA 40. The seal head 210 may again be operated to engage the wireline 80. Pressure may be equalized and the lubricator tested. Referring to FIG. 9C, the annular BOP 65 may be disengaged from the motor 110. The upper clamp 41*u* may be operated to release the motor 110. The first and second deployment sections 100*a,b* may be lowered into the PCA 40 until the shaft seal groove 102 is aligned with the upper clamp 41*u*. The upper clamp 41*u* may then be operated to engage the shaft seal 115, thereby supporting the first and second deployment sections 100*a,b*. The annular BOP 65 may then be operated to engage an outer surface of the shaft seal 115. Pressure may be bled and the annular BOP tested. As with the first deployment section 100*a*, the shaft seal 115 may serve as a plug.

Figure 10A:
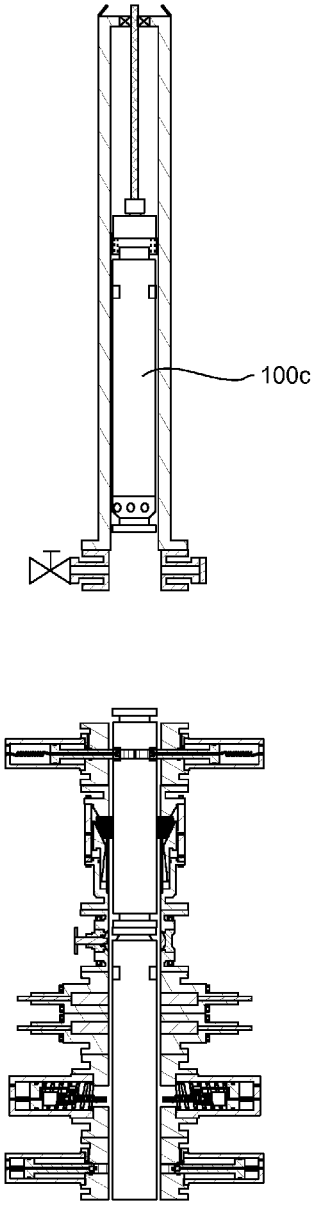
Figure 10B:
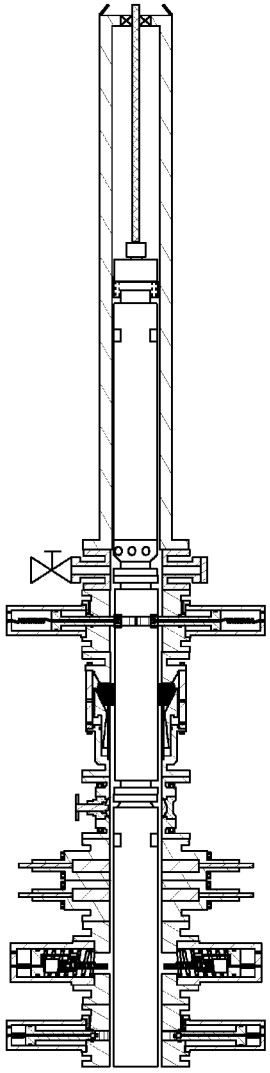
Figure 10C:
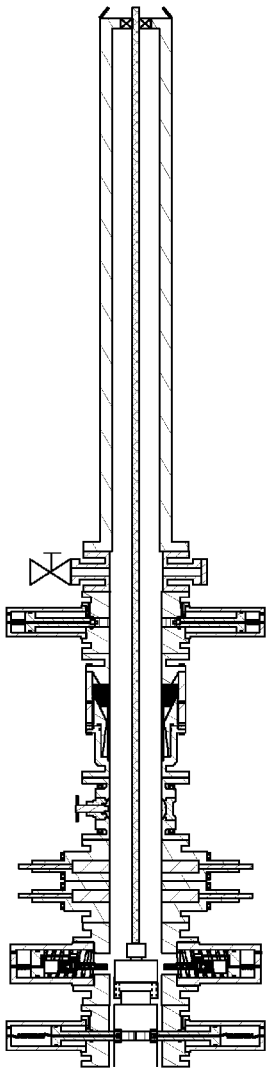

Referring to FIG. 10A, pressure in the lubricator 200 may be bled using the valve 220 and the lubricator connection to the PCA 40 may be disassembled. The running tool 250*a* may be operated to release the second deployment section 100*b* using the wireline 80. The lubricator 200 and running tool 250*a* may then be removed. The third deployment section 100*c* may be inserted into the tool housing 205 and connected to the running tool 250*a*. The lubricator 200 and third deployment section 100*c* may be hoisted over the PCA 40 using the wireline 80 and/or the crane 90. Referring to FIG. 10B, the crane 90 may suspend the lubricator 200 while the wireline winch 77 is operated to lower the third deployment section 100*c* until the lower first pump section flange 101 seats on the upper shaft seal flange 101. During lowering, the flanges 101 may be manually aligned and the upper seal shaft coupling 103 may be manually aligned and engaged with the lower pump section shaft coupling 103. The flanged connection 101 may be assembled. The lubricator 200 may be lowered onto the PCA 40 using the crane 90. The lubricator tee 215 may again be fastened to the PCA 40. The seal head 210 may again be operated to engage the wireline 80. Pressure may be equalized and the lubricator tested. Referring to FIG. 10C, the annular BOP 65 may be disengaged from the shaft seal 115. The upper clamp 41*u* may be operated to release the shaft seal 115. The first, second, and third deployment sections 100*a-c* may be lowered into the PCA 40 until the first pump section groove 102 is aligned with the lower clamp 41*b*. The lower clamp 41*b* may then be operated to engage the first pump section 125, thereby supporting the deployment sections 100*a-c*.

Since the deployment sections 100*c,d* may have open through-bores, the open deployment sections may not be used as plugs and the isolation valve 62 may be used to close the upper portion of the PCA.

Figure 11A:
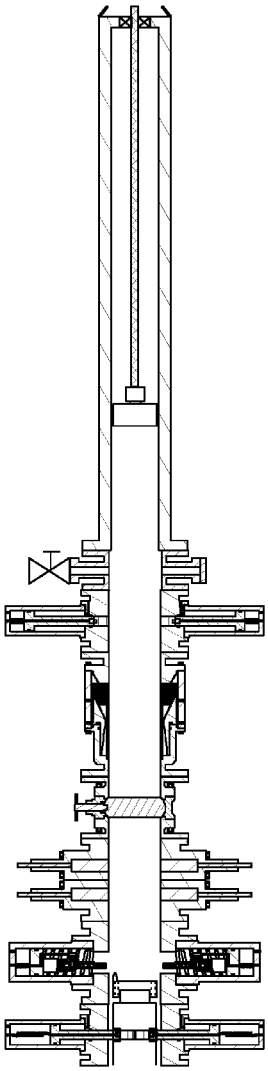
Figure 11B:
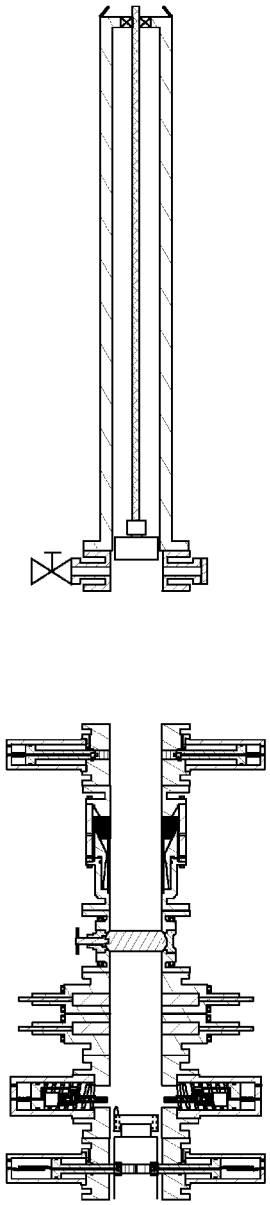
Figure 11C:
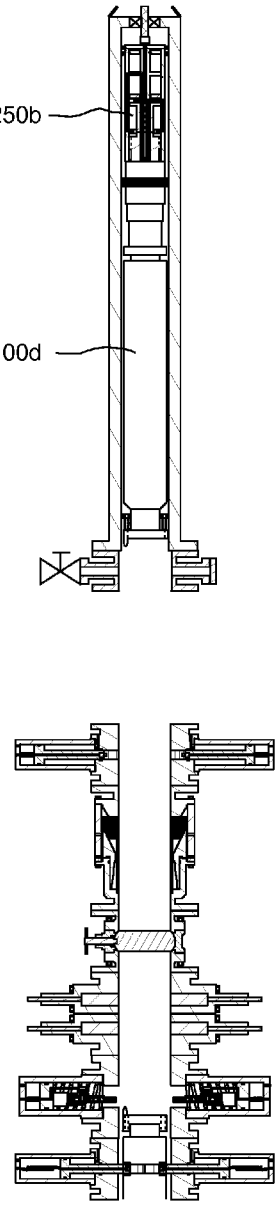

Referring to FIG. 11A, the running tool 250*a* may be operated to release the third deployment section 100*c* using the wireline 80. The running tool 250*a* may be raised from the PCA 40 into the lubricator 200 using the wireline 80. The isolation valve 62 may be closed. Pressure may be bled and the isolation valve tested. Referring to FIG. 11B, pressure in the lubricator 200 may be bled using the valve 220 and the lubricator connection to the PCA 40 may be disassembled. The lubricator 200 and running tool 250*a* may then be removed. Referring to FIG. 11C, the running tool 250*a* may be disconnected from the wireline 80 and the running tool 250*b* connected to the wireline. The fourth deployment section 100*d* may be inserted into the tool housing 205 and connected to the running tool 250*b*. The lubricator 200 and fourth deployment section 100*d* may be hoisted over the PCA 40 using the wireline 80 and/or the crane 90.

Figure 12A:
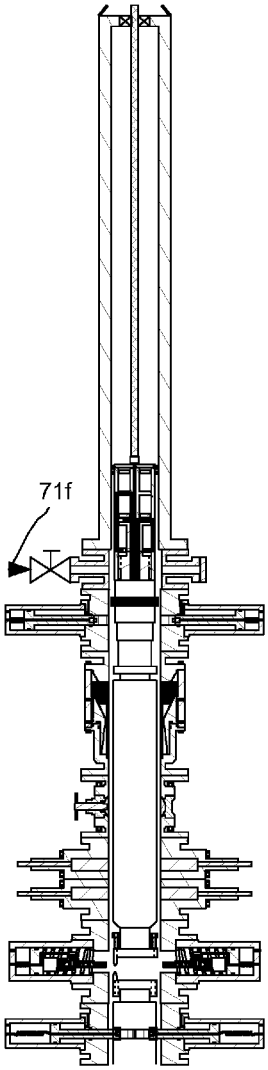
Figure 12B:
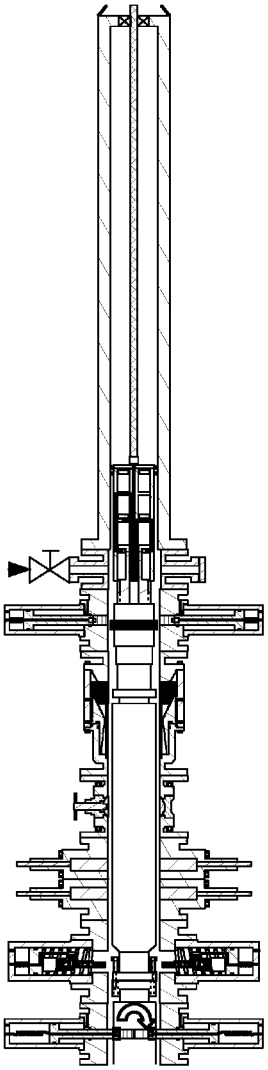
Figure 12C:
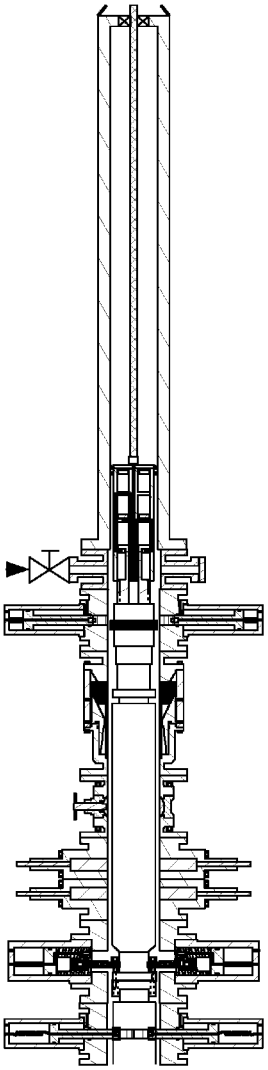

Referring to FIG. 12A, the lubricator 200 may be lowered onto the PCA 40 using the crane 90. The lubricator tee 215 may again be fastened to the PCA 40. The seal head 210 may again be operated to engage the wireline 80. Pressure may be equalized and the lubricator tested. The isolation valve 62 may be opened. The valve 220 may be connected to the visibility fluid unit 71 and the visibility fluid 71*f* may be injected into the PCA 40. The running tool 250*b* and fourth deployment section 100*d* may be lowered into the PCA 40 until the upper first pump section flange 130*u* is proximate to the lower second pump section flange 130*b*. Referring to FIG. 12B, the piston 286*p* may be operated to slowly lower the fourth deployment section 100*d* and carefully engage the parts of the auto-orienting profile 132. Since the running tool 250*b* may be torsionally connected to the lubricator 200 and torsionally connected to the isolation device 140, the auto-orienting profile 132 may rotate the first-third deployment sections 100*a-c* relative to the fourth deployment section 100*d* for aligning the flanges 130*u,b*. The lower clamp 41*b* may accommodate the rotation. There may also be some incidental rotation (not shown) of the fourth deployment section 100*d* by the cam 270 or the fourth deployment section may rotate instead of the first-third deployment sections 100*a-c* depending on the configuration of the running tool 250*b*. Once the auto-orienting profile 132 has mated, the running tool 250*b* may be operated to rotate the deployment sections 100*a-d* relative to the PCA 40 until a first pair of the bolts 131 are aligned with the driver 50. Visual feedback from the video camera may facilitate alignment of the first bolt pair with the driver 50. Referring to FIG. 12C, the driver arm assemblies 53 may be operated to engage the bolts 131.

Alternatively, the PCA 40 may include a rotary table (not shown) operable to rotate the lubricator 200 relative to the PCA 40. The rotary table may be used instead of the cam 270 and follower 256 of the running tool 250*b* for aligning the driver 50 with the bolts 131. The rotary table may include a stator connected to the upper clamp 41*u*, such as by a flanged connection, a rotor connected to the lubricator 200, such as by a flanged connection, a motor for rotating the rotor relative to the stator, a swivel for providing fluid communication between the wireline truck 70 and the seal head 210, and a bearing for supporting the rotor from the stator.

Alternatively, the auto-orienting profile 132 may be omitted and the running tool 250*b* or the rotary table may be used to align the flanges 130*u,b* instead of the auto-orienting profile.

Alternatively, instead of the anti-rotation guide 280, each of the running tool 250*b* and the tool housing 205 may include a mating torsion profile, such as a key and keyway or splines. The torsion profile may torsionally connect the running tool 250*b* and the tool housing 205 while allowing relative longitudinal movement therebetween. The running tool 250*a* may also include the torsion profile. Each of the running tools 250*a,b* and downhole components 100*a-d* may also have an alignment profile corresponding to the orientation of the flanges 101, 130*u,b*. Using the torsion profiles and alignment profiles may obviate having to align the flanges 101, 130*u,b* during assembly of the deployment sections 100*a-d*.

Figure 13A:
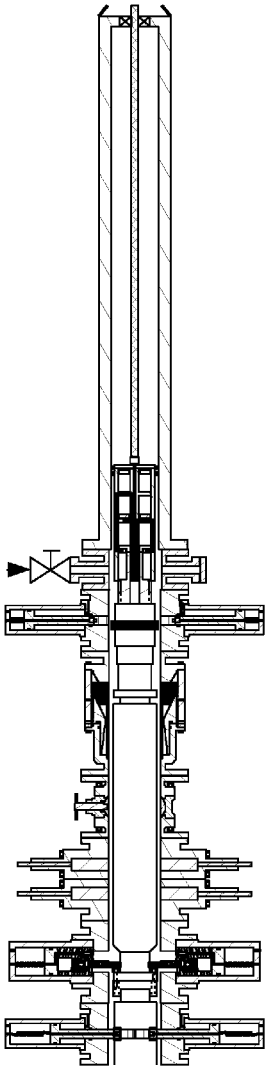
Figure 13B:
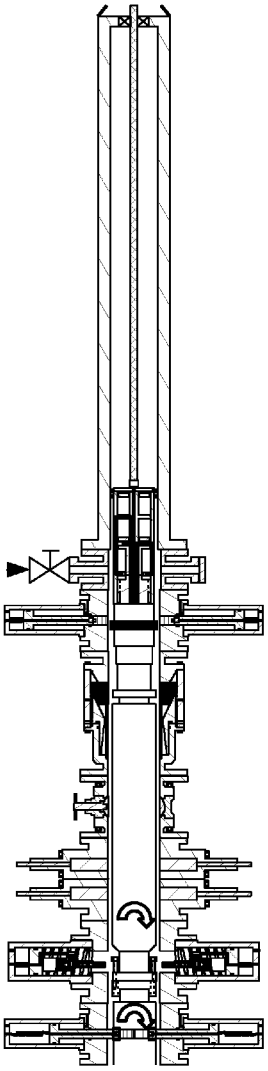
Figure 13C:
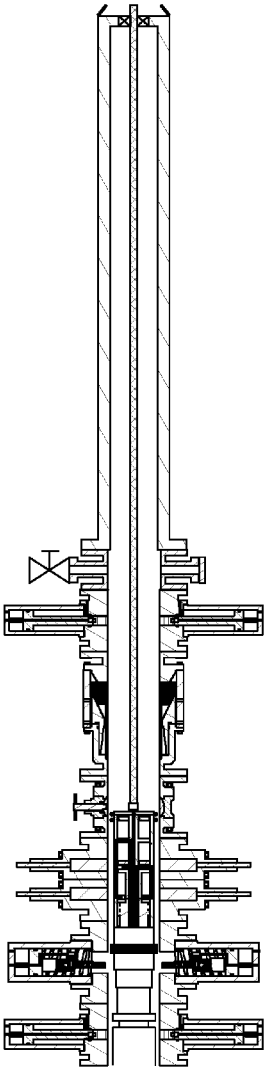

Referring to FIG. 13A, each driver motor 56 may be operated to rotate the bolts 131 into respective sockets 133. The driver units 50*a,b* may be operated in parallel or series. Torque and turns may be monitored by the control room operator and/or the PLC 72*p* to ensure proper assembly. Referring to FIG. 13B, the arm assemblies 53 may be disengaged from the upper flange 130*u*. The running tool 250*b* may be operated to align the next pair of bolts 131 with the driver 50. The driver arm assemblies 53 may again be operated to engage the next pair of bolts 131 and the driver motors 56 again operated to assemble the bolts 131 into the respective sockets 133. The bolt driving operation may be repeated until the flanged connection 130*ub*, has been fully assembled. Referring to FIG. 13C, the lower clamp 41*b* may be operated to disengage the first pump section housing 125*h* and the assembled ESP 100 may be lowered into the wellbore 5*w*.

Figure 14B:
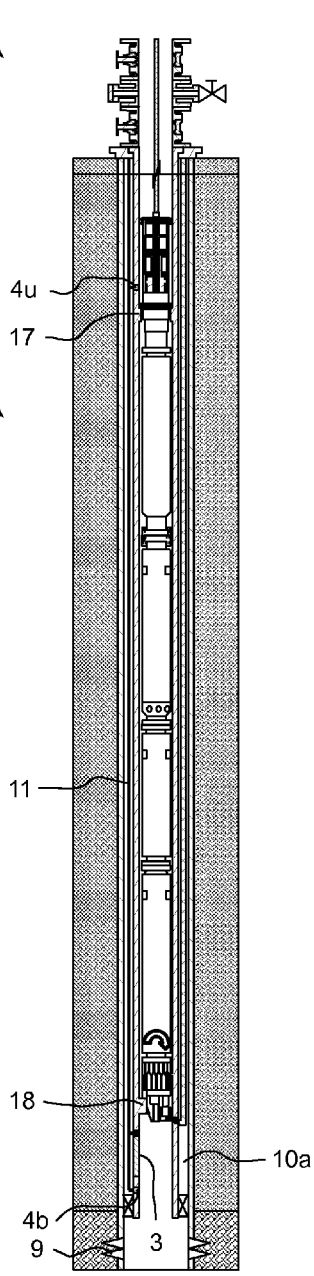
Figure 14C:
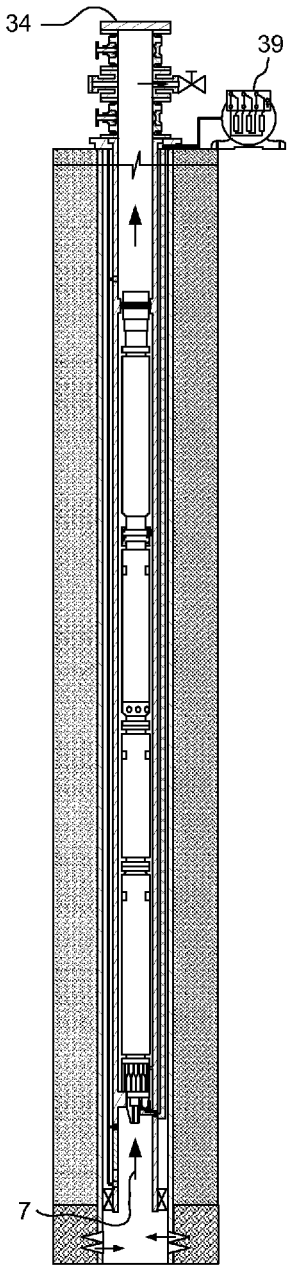

Referring to FIG. 14A, the ESP 100 may be lowered into the wellbore 5*w* using the wireline 80 until the lander 105 is proximate the dock follower 13. Referring to FIG. 14B, the ESP 100 may be slowly lowered while the follower 13 engages the cam 109 and rotates the ESP 100 relative to the production tubing 10*p* to align the wet-matable connector 16, 106. Referring to FIG. 14C, lowering of the ESP 100 may continue to engage the wet-matable connector 16, 106 and to engage the isolation device seal with the PBR 17. The isolation device latch may be set. The running tool gripper 265 may be operated using the wireline 80 to release the ESP 100 from the running tool 250*b*. The running tool 250*b* may be removed from the wellbore 5*w* into the lubricator 200. The master 31 and swab 33 valves may be closed. The lubricator 200 may be bled and the lubricator 200 and running tool 250*b* removed from the PCA 40. The PCA 40 may be removed from the production tree 30. The cap 34 may be connected to the production tree 30. The tree valves 31, 33 may be opened and the ESP 100 operated to pump production fluid 7 from the wellbore 5*w*. Retrieval of the ESP 100 for service or replacement may be accomplished by reversing the insertion method.

Alternatively, the running tool 250*b* may be operated to land the ESP 100 into the dock 15. Further, the running tool 250*b* may include an anchor (not shown). The anchor may be operated after the running tool 250*b* has landed in the dock 15 to longitudinally connect the running tool housing 255 to the production tubing 10*p*. The running tool piston 286*p* may then be operated to set the isolation device 140.

Alternatively, the running tool 250*b* may be replaced by the running tool 250*a* for lowering the assembled ESP 100 into the wellbore 5*w*.

Alternatively, the LARS 1 may be used to insert the ESP 100 into a subsea wellbore having a production tree at or above waterline.

Figure 15A:
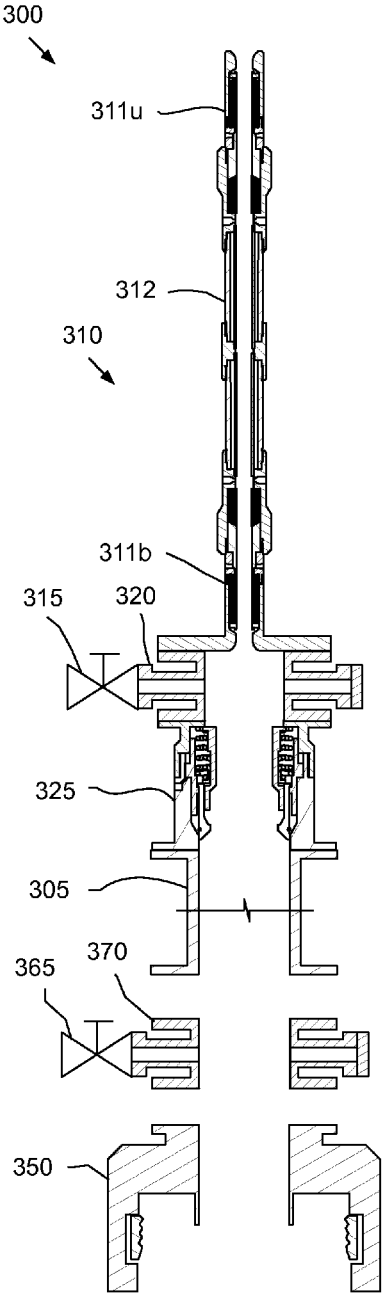
FIG. 15A illustrates portions of a subsea LARS, according to another embodiment of the present invention.

FIG. 15A illustrates portions of a subsea LARS, according to another embodiment of the present invention. The subsea LARS may include the lubricator 300 instead of the lubricator 100. The lubricator 300 may include a tool housing 305, a seal head 310, a tee 315, a shutoff valve 320, and a tool catcher 325. Components of the lubricator 300 may be connected, such as by flanged connections. The tool housing 305 may also have a lower flange for connecting to an upper flange of an upper clamp of a subsea PCA. The seal head 310 may include one or more stuffing boxes 311*u,b* and a grease injector 312. The subsea PCA may be similar to the PCA 40 except that a tee 370 and shutoff valve 365 may be added between the annular BOP 65 and the upper clamp 41*u* and a subsea production tree adapter 350 may be added below the lower clamp 41*b*. The tree adapter 350 may include a connector, such as dogs, for fastening the subsea PCA to an external profile of a subsea production tree (not shown) and a seal sleeve for engaging an internal profile of the tree. The tree adapter 350 may further include an electric or hydraulic actuator and an interface, such as a hot stab, so that a remotely operated subsea vehicle (ROV) (not shown) may operate the actuator for engaging the dogs with the external profile.

Instead of the wireline truck 70 and the crane 90, the subsea LARS may include a support vessel (not shown). The support vessel may be a light or medium intervention vessel and include a dynamic positioning system to maintain position of the vessel on the waterline over the subsea tree and a heave compensator (not shown) to account for vessel heave due to wave action of the sea. The vessel may further include a tower located over a moonpool, a lifting winch, and a wireline winch. Alternatively, the vessel may include a crane instead of the lifting winch. The subsea LARS may deploy and retrieve the ESP 100 into/from a subsea wellbore via the subsea tree riserlessly and similarly to the LARS 1 except that an ROV may perform the manual steps, discussed above. For retrieval of the ESP 100 from the wellbore, the tees 320, 370 may allow circulation of a cleaning fluid to wash wellbore residue off of the deployment sections 100*a-d* before removing the sections from the PCA.

Alternatively, the support vessel may be a heavy intervention vessel or a mobile offshore drilling unit (MODU) and a marine riser (not shown) may be used instead of the tool housing 305.

Alternatively, the tool housing 305 and the upper clamp may each include one of the mating parts of an actuated connection. The actuated connection may include an interface, an actuator, a connector, a connector profile, and a seal assembly. The connector may be dogs or a collet. The seal assembly may further include a seal face or sleeve and a seal. The actuator may be hydraulic and include a piston and a cam for operating the connector. The interface may be an ROV interface, such as a hot stab, and/or a vessel interface, such as a hydraulic conduit.

Figure 15B:
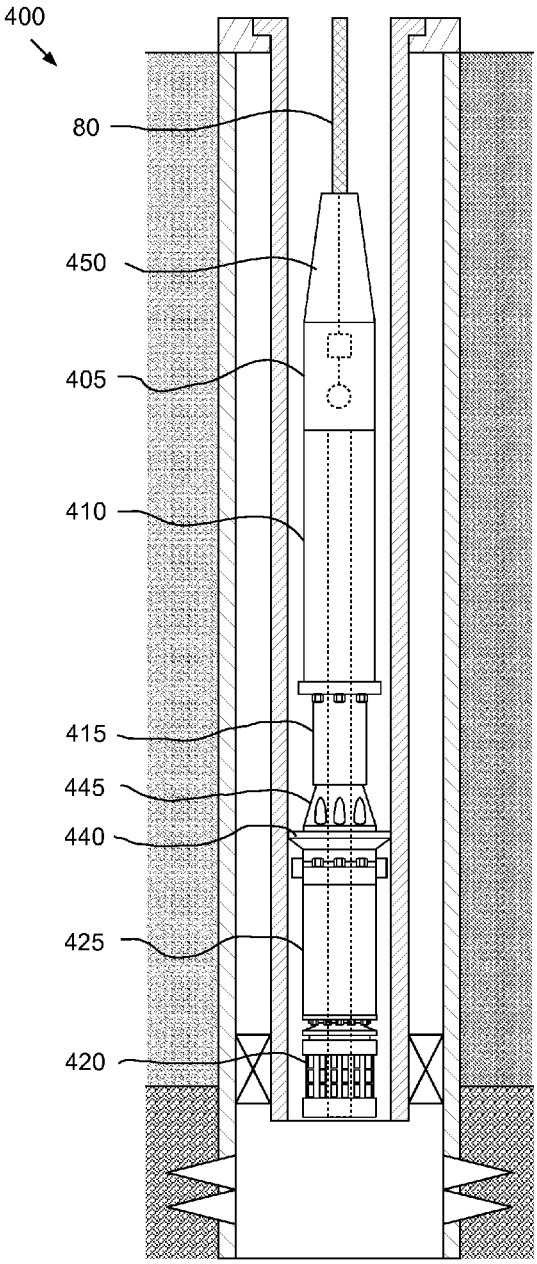
FIG. 15B illustrates a power cable-deployed ESP for use with the LARS, according to another embodiment of the present invention.

FIG. 15B illustrates a power cable-deployed ESP 400 for use with the LARS 1, according to another embodiment of the present invention. The ESP 400 may include an electric motor 410, a shaft seal 415, a pump 425 having one or more stages (only one shown), an isolation device 440, a power converter 405, and a cablehead 450. The motor 410 may be similar to the motor 110, discussed above. The shaft seal 415 may be similar to the shaft seal 115, discussed above. Although only one section is shown, the pump 425 may be similar to the pump 125, 135 discussed above.

The ESP 400 may be inserted into the PCA 40 in a similar fashion to the ESP 100, discussed above, except that the order of steps may be changed to accommodate the change in order of components of the ESP 400 relative to the ESP 100. Further, instead of using one of the running tools 250*a,b* to deploy the final deployment section, the cablehead 450 may be used since the wireline 80 will remain in the wellbore 5*w* with the ESP 400 as a power cable for operation thereof.

The control unit (not shown) may include a power source, such as a generator or transmission lines, and a power converter. The power converter may include a one or more (three shown) phase transformer for stepping the voltage of the AC power signal supplied by the power source from a low voltage signal to a medium voltage signal. The low voltage signal may be less than or equal to one kilovolt (kV) and the medium voltage signal may be greater than one kV, such as five to ten kV. The power converter may further include a one or more (three shown) phase rectifier for converting the medium voltage AC signal supplied by the transformer to a medium voltage direct current (DC) power signal. The rectifier may supply the medium voltage DC power signal to the wireline 80.

The power converter 405 may receive the medium voltage DC signal from the wireline 80 via the cablehead 450. The power converter 405 may include a power supply and a motor controller. The power supply may include one or more DC/DC converters, each converter including an inverter, a transformer, and a rectifier for converting the DC power signal into an AC power signal and reducing the voltage from medium to low. Each DC/DC converter may be a single phase active bridge circuit as discussed and illustrated in US Pub. Pat. App. 2010/0206554, which is herein incorporated by reference in its entirety. The power supply may include multiple DC/DC converters (only one shown) connected in series to gradually reduce the DC voltage from medium to low. For the SRM and BLDC motors, the low voltage DC signal may then be supplied to the motor controller. For the induction motor, the power supply may further include a three-phase inverter for receiving the low voltage DC power signal from the DC/DC converters and outputting a three phase low voltage AC power signal to the motor controller.

The isolation device 440 may include a packing, an anchor, and an actuator. The actuator may be operated mechanically by articulation of the wireline 80, electrically by power from the wireline 80, or hydraulically by discharge pressure from the pump 425. The packing may be made from a polymer, such as a thermoplastic, elastomer, or copolymer, such as rubber, polyurethane, or PTFE. The isolation device 440 may have a bore formed therethrough in fluid communication with the pump outlet and have one or more discharge ports 445 formed above the packing for discharging the pressurized reservoir fluid 7 into the production tubing 10*p*. Once the ESP 400 has reached deployment depth, the isolation device actuator may be operated, thereby setting the anchor and expanding the packing against the production tubing 10*p*, isolating the pump inlet 420 from the pump outlet, and torsionally connecting the ESP 400 to the production tubing 10*p*. The anchor may also longitudinally support the ESP 400.

Alternatively, the power converter 450 may be omitted and the ESP 400 may be deployed with the power cable 20 instead of the wireline 80. Alternatively, the ESP 400 may be deployed using the subsea LARS.

While the foregoing is directed to embodiments of the present invention, other and further embodiments of the invention may be devised without departing from the basic scope thereof, and the scope thereof is determined by the claims that follow.

The invention claimed is:

1. A method of inserting a downhole assembly into a live wellbore, comprising:

assembling a pressure control assembly (PCA) onto a production tree of the live wellbore;

inserting a first deployment section of the downhole assembly into a lubricator;

landing the lubricator onto the PCA;

connecting the lubricator to the PCA;

lowering the first deployment section into the PCA;

engaging a clamp of the PCA with the first deployment section;

after engaging the clamp, closing an isolation valve of the PCA, thereby isolating an upper portion of the PCA from a lower portion of the PCA;

after isolating the PCA, removing the lubricator from the PGA;

connecting a second deployment section to the first deployment section;

connecting a third deployment section to the second deployment section;

inserting a fourth deployment section of the downhole assembly into the lubricator;

landing the lubricator onto the PCA;

connecting the lubricator to the PCA;

opening the isolation valve of the PCA;

lowering the fourth deployment section into the PCA to a position adjacent a top of the third deployment section; and while the lubricator is connected to the PCA:

orienting a lower flange of the fourth deployment section with an upper flange of the third deployment section to align threaded fasteners of the upper flange with threaded sockets of the lower flange;

rotating the oriented third and fourth deployment sections to align one of the threaded fasteners with a wrench of the PCA;

engaging the wrench with the aligned threaded fastener and operating the wrench to screw the threaded fastener into the threaded socket;

disengaging the wrench from the threaded fastener;

incrementally rotating the third and fourth deployment sections to align another one of the threaded fasteners with the wrench; and repeating the engaging, disengaging, and incrementally rotating steps until the flanged connection between the third and fourth deployment sections is assembled.

2. The method of claim 1, wherein the PCA is isolated by engaging a seal of the PCA with the first deployment section, thereby plugging a bore of the PCA.

3. The method of claim 2, wherein a top of the first deployment section is adjacent a top of the PCA while the clamp is engaged.

4. The method of claim 3, further comprising, while the first deployment section is isolating the PCA:

inserting the second deployment section of the downhole assembly into the lubricator;

suspending the lubricator and second deployment section over the PCA; and lowering the second deployment section from the lubricator to a position adjacent the top of the first deployment section.

5. The method of claim 4, further comprising, after connecting the first and second deployment sections:

landing the lubricator onto the PCA;

connecting the lubricator to the PCA;

disengaging the seal from the first deployment section;

disengaging the clamp from the first deployment section; and lowering the first and second deployment sections into the PCA.

6. The method of claim 5, further comprising:

engaging the clamp with the second deployment section;

engaging the seal with the second deployment section, thereby plugging the PCA bore; and after engaging the seal with the second deployment section, removing the lubricator from the PCA.

7. The method of claim 6, further comprising:

inserting the third deployment section of the downhole assembly into the lubricator;

suspending the lubricator and third deployment section over the PCA; and lowering the third deployment section from the lubricator to a position adjacent the top of the second deployment section.

8. The method of claim 7, wherein:

the clamp is an upper clamp, the PCA further comprises a lower clamp, and the method further comprises, after connecting the second and third deployment sections:

connecting the lubricator to the PCA lowering the third deployment section into the PCA;

engaging the lower clamp with the third deployment section;

closing the isolation valve of the PCA; and after closing the isolation valve, removing the lubricator from the PCA.

9. A method of inserting a downhole assembly into a live wellbore, comprising:

assembling a pressure control assembly (PCA) onto a production tree of the live wellbore;

inserting a first deployment section of the downhole assembly into a lubricator;

landing the lubricator onto the PCA;

connecting the lubricator to the PCA;

lowering the first deployment section into the PCA;

engaging a clamp of the PCA with the first deployment section;

after engaging the clamp, closing an isolation valve of the PCA, thereby isolating an upper portion of the PCA from a lower portion of the PCA;

after isolating the PCA, removing the lubricator from the PCA;

inserting a second deployment section of the downhole assembly into the lubricator;

landing the lubricator onto the PCA;

connecting the lubricator to the PCA;

opening the isolation valve;

lowering the second deployment section into the PCA to a position adjacent a top of the first deployment section; and while the lubricator is connected to the PCA and the clamp is engaged with the second deployment section:

orienting a lower flange of the second deployment section with an upper flange of the first deployment section to align threaded fasteners of the upper flange with threaded sockets of the lower flange;

rotating the oriented first and second deployment sections to align one of the threaded fasteners with a wrench of the PCA;

engaging the wrench with the aligned threaded fastener and operating the wrench to screw the threaded fastener into the threaded socket;

disengaging the wrench from the threaded fastener;

incrementally rotating the first and second deployment sections to align another one of the threaded fasteners with the wrench; and repeating the engaging, disengaging, and incrementally rotating steps until the flanged connection between the first and second deployment sections is assembled.

10. system for inserting a downhole assembly into a live wellbore, comprising:

a pressure control assembly, comprising:

a first clamp comprising a housing having a bore therethrough and bands or slips, each band or slip radially movable relative to the first clamp housing into and from the first clamp bore;

a second clamp comprising a housing having a bore therethrough and bands or slips, each second band or slip radially movable relative to the second clamp housing into and from the second clamp bore;

a preventer or packer comprising a housing having a bore therethrough, a seal, and an actuator operable to extend and retract the seal into and from the preventer or packer housing bore;

an isolation valve comprising a housing having a bore therethrough and a valve member operable to open and close the valve bore; and a driver comprising a housing having a bore therethrough and a wrench radially movable relative to the housing into and from the driver bore, the wrench comprising a motor and a socket, the socket operable to engage a threaded fastener and the motor operable to rotate the socket, wherein the clamp housings, the preventer or packer housing, the valve housing, and the driver housing are connected to form a continuous bore through the assembly;

a flanged connection comprising:

a lower flange for connection to a first deployment section of the downhole assembly; and an upper flange for connection to a second deployment section of the downhole assembly, wherein:

each flange has a portion of an auto-orienting profile, the upper flange carries a plurality of the threaded fasteners trapped thereto, and the lower flange has a plurality of threaded sockets for receiving the threaded fasteners; and a running tool having a cablehead for connection to a wireline and operable to incrementally rotate the deployment sections for aligning the threaded fasteners with the wrench.

* * * * *